US011289265B2

(12) United States Patent
Matsumoto et al.

(10) Patent No.: US 11,289,265 B2
(45) Date of Patent: Mar. 29, 2022

(54) INDUCTOR HAVING CONDUCTIVE LINE EMBEDDED IN MAGNETIC MATERIAL

(71) Applicant: SHINKO ELECTRIC INDUSTRIES CO., LTD., Nagano (JP)

(72) Inventors: Takayuki Matsumoto, Nagano (JP); Tsukasa Nakanishi, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 687 days.

(21) Appl. No.: 16/211,755

(22) Filed: Dec. 6, 2018

(65) Prior Publication Data

US 2019/0206611 A1 Jul. 4, 2019

(30) Foreign Application Priority Data

Dec. 28, 2017 (JP) ..... JP2017-253083
Aug. 23, 2018 (JP) ..... JP2018-156607

(51) Int. Cl.

| | |
|---|---|
| ***H01F 27/29*** | (2006.01) |
| ***H01F 27/24*** | (2006.01) |
| ***H01F 27/32*** | (2006.01) |
| ***H01F 17/04*** | (2006.01) |
| ***H01F 17/00*** | (2006.01) |
| *H01F 41/04* | (2006.01) |
| *H01F 27/28* | (2006.01) |

(52) U.S. Cl.

CPC ..... *H01F 27/29* (2013.01); *H01F 17/0006* (2013.01); *H01F 17/04* (2013.01); *H01F 27/24* (2013.01); *H01F 27/32* (2013.01); *H01F 27/2847* (2013.01); *H01F 41/04* (2013.01); *H01F 2017/048* (2013.01)

(58) Field of Classification Search

CPC ..... H01F 27/29; H01F 17/04; H01F 17/0006; H01F 27/24; H01F 27/32; H01F 2017/048; H01F 27/2847; H01F 41/04

See application file for complete search history.

(56) References Cited

U.S. PATENT DOCUMENTS

2004/0166370 A1* 8/2004 Mizoguchi ..... H01F 17/0006 428/692.1

FOREIGN PATENT DOCUMENTS

| | | | |
|---|---|---|---|
| JP | 2001244124 A | * | 9/2001 |
| JP | 2003-168610 | | 6/2003 |
| JP | 2008-078178 | | 4/2008 |

* cited by examiner

*Primary Examiner* — Tuyen T Nguyen
(74) *Attorney, Agent, or Firm* — IPUSA, PLLC

(57) ABSTRACT

An inductor includes a magnetic material containing a magnetic powder and an insulating resin, a conductive line embedded in the magnetic material, a first electrode partially exposed from the magnetic material and connected to one end of the conductive line, and a second electrode partially exposed from the magnetic material and connected to another end of the conductive line.

21 Claims, 32 Drawing Sheets

FIRST CROSS-SECTION
SECOND CROSS-SECTION
21a
1x
19b
22
21
9
19
1y
21b
19a
1w
19
21
9
1w
22
1w

FIRST CROSS-SECTION
SECOND CROSS-SECTION
24
23
1x
21a
19b
22
21
9
19
25
23
1y
21b
19a
1w
19
21
9
1w
22
1w

INDUCTOR HAVING CONDUCTIVE LINE EMBEDDED IN MAGNETIC MATERIAL

CROSS-REFERENCE TO RELATED APPLICATIONS

The present application is based on and claims priority to Japanese patent applications No. 2017-253083 filed on Dec. 28, 2017 and No. 2018-156607 filed on Aug. 23, 2018 with the Japanese Patent Office, the entire contents of which are incorporated herein by reference.

FIELD

The disclosures herein relate to an inductor and a method of making an inductor.

BACKGROUND

Various types of electronic components are used in small-size electronic products such as smartphones and tablet terminals. An inductor is one of such electronic components. Inductors are used in multiphase DC-DC converters or the like for supplying electrical power to a CPU (central processing unit), for example.

There are various types of inductors, among which a helical type having a coil wound around a magnetic core is widely used.

It is difficult to make a thin helical inductor because the magnetic core three-dimensionally occupies a large space, which is disadvantageous in terms of reducing the size of an electronic product.

According to one aspect, there may be a need for a thin inductor.

RELATED-ART DOCUMENTS

Patent Document

[Patent Document 1] Japanese Patent Application Publication No. 2003-168610

SUMMARY

According to an aspect of the embodiment, an inductor includes a magnetic material containing a magnetic powder and an insulating resin, a conductive line embedded in the magnetic material, a first electrode partially exposed from the magnetic material and connected to one end of the conductive line, and a second electrode partially exposed from the magnetic material and connected to another end of the conductive line.

The object and advantages of the embodiment will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

In the following, embodiments will be described by referring to the accompanying drawings. In these drawings, the same elements are referred to by the same references, and a duplicate description thereof may be omitted.

First Embodiment

An inductor of a present embodiment will be described along with the method of making the same.

Figure 1:
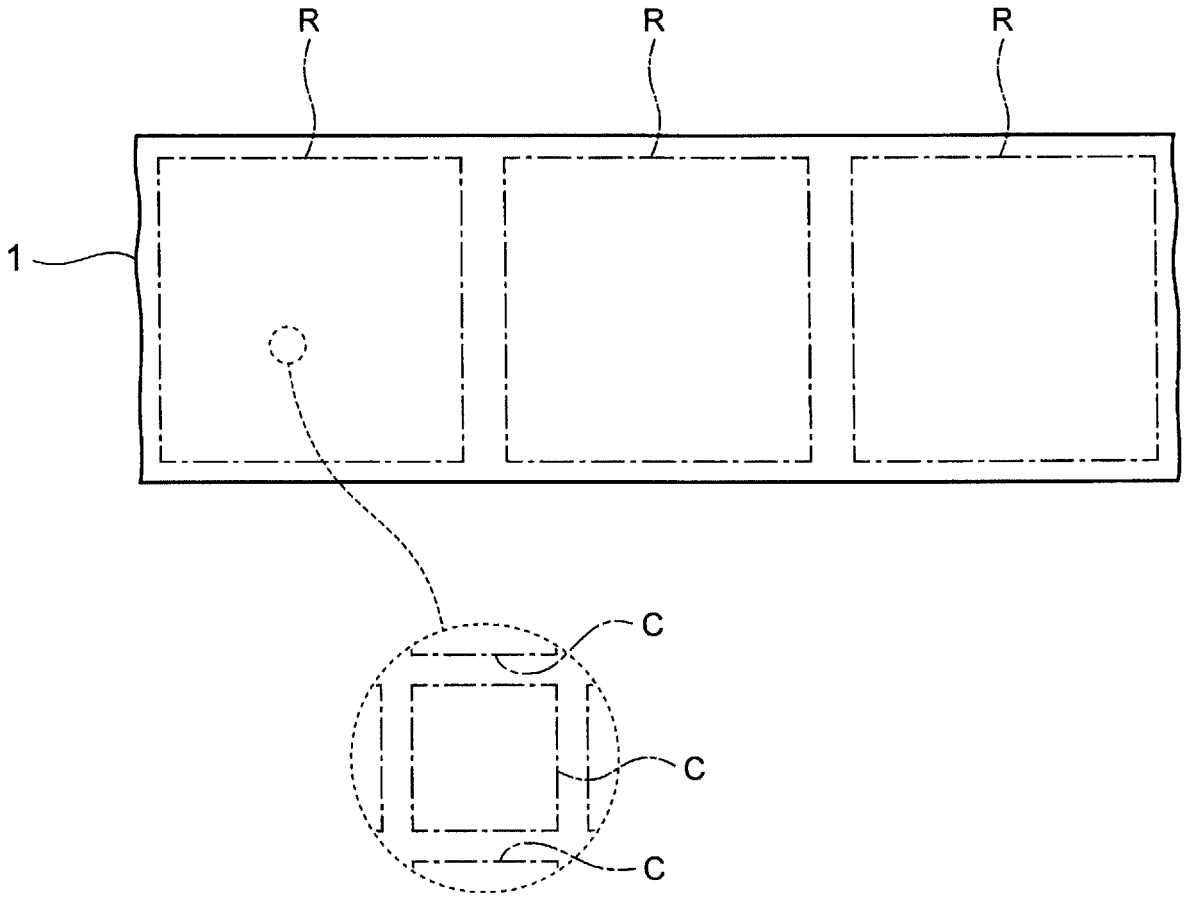
FIG. 1 is a plan view of a metal plate used in a first embodiment.

FIG. 1 is a plan view of a metal plate used in a first embodiment.

A metal plate 1 is a copper plate, for a lead frame, having a thickness of approximately 0.2 mm. There are a plurality of product areas R. Each of the product areas R includes a plurality of rectangular device areas C, from which respective inductors are cut out at a later stage. In this example, one product area R includes a plurality of device areas C arranged in a matrix form.

The material of the metal plate 1 is not limited to copper. A copper alloy may alternatively be used as the material of the metal plate 1. An Fe—Ni alloy such as a 42 alloy may alternatively be used as the material of the metal plate 1.

In the present embodiment, inductors are formed in the device areas C of the metal plate 1.

FIGS. 2A and 2B through 7A and 7B are cross-sectional views of an inductor of the first embodiment during the manufacturing stage. FIGS. 8 through 14 are plan views of the inductor Each of FIGS. 2A and 2B through 7A and 7B illustrate both a first cross-section taken along the line A-A and a second cross-section taken along the line B-B, which are shown in FIG. 8 through FIG. 14.

Figure 2A:
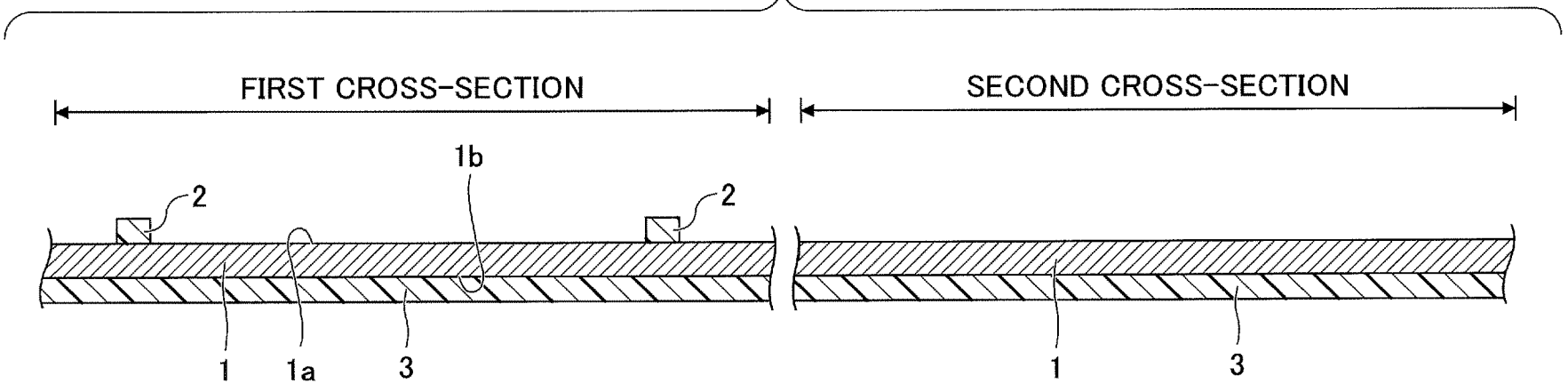
FIGS. 2A and 2B are cross-sectional views of an inductor of a first embodiment during the manufacturing stage.
Figure 8:
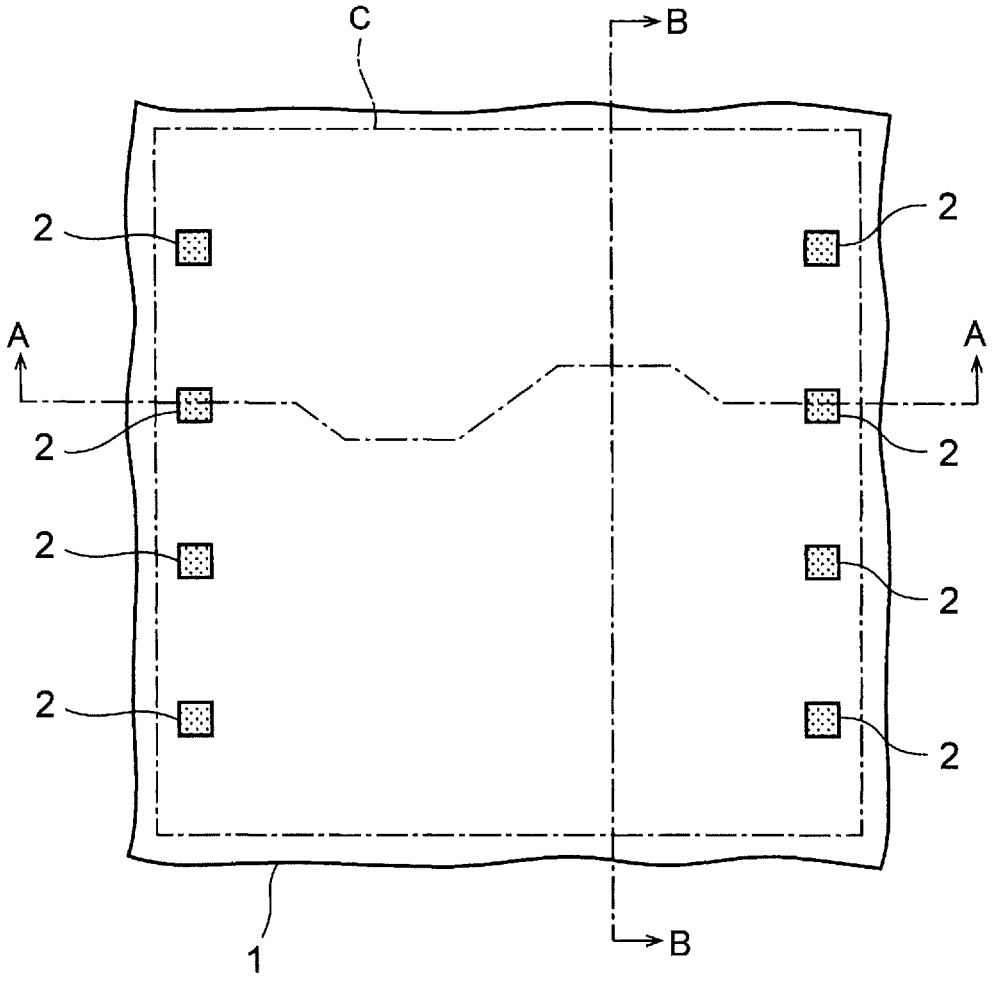
FIG. 8 is a plan view of the inductor of the first embodiment during the manufacturing stage.

As illustrated in FIG. 2A and FIG. 8, a first resist layer 2 formed as isolated islands is disposed on a front face 1*a* of the metal plate 1, and a back face 1*b* of the metal plate 1 is covered with a second resist layer 3.

Figure 2B:
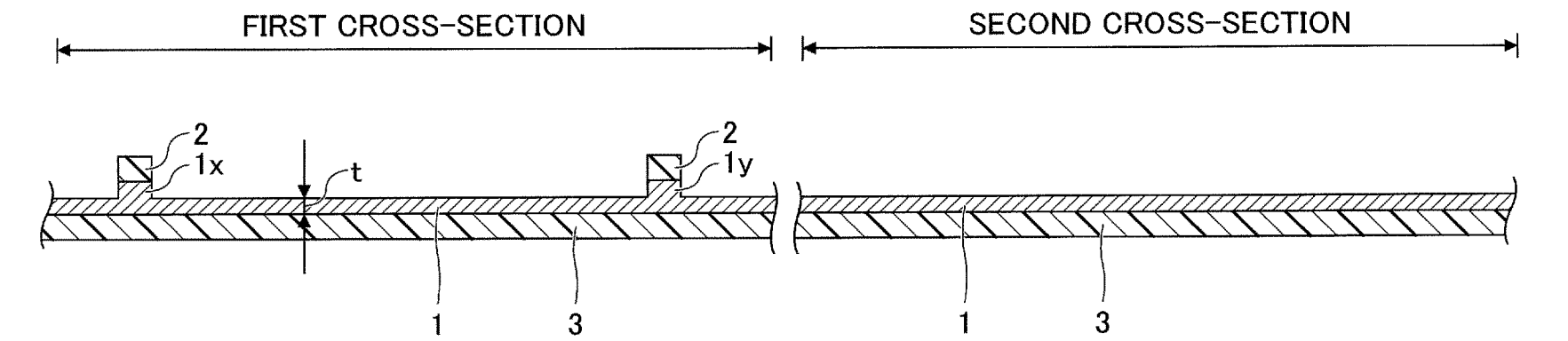

As illustrated in FIG. 2B, the resist layers 2 and 3 are used as masks to perform wet-etching so that the portions of the metal plate 1 not covered with the first resist layer 2 are etched halfway through the thickness thereof. As a result, a first terminal 1*x* and a second terminal 1*y* are formed on the metal plate 1 at a spaced interval under the first resist layer 2. A thickness t of the metal plate 1 at the places other than the positions of the terminals 1*x* and 1*y* is thinned to approximately 0.1 mm.

The resist layers 2 and 3 are then removed.

Figure 9:
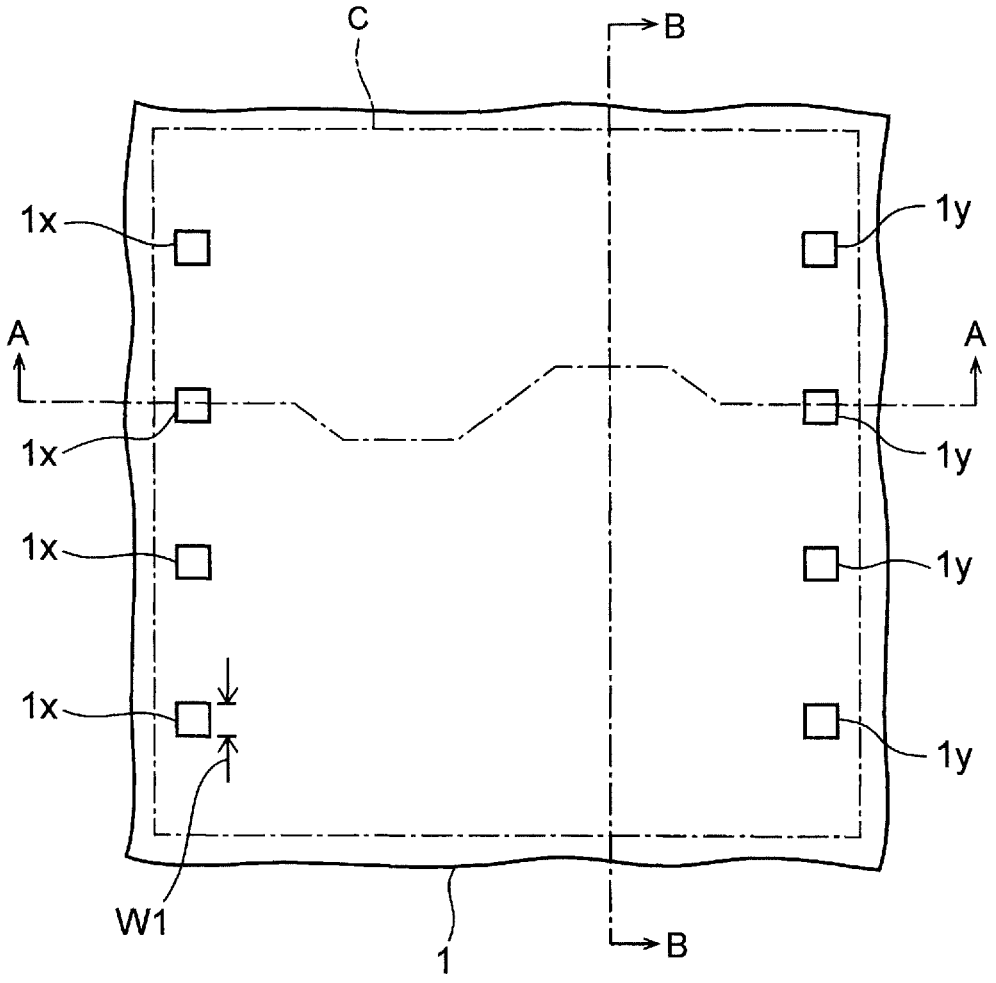
FIG. 9 is a plan view of the inductor of the first embodiment during the manufacturing stage.

FIG. 9 is a plan view of the metal plate 1 after the removal of the resist layers 2 and 3.

As illustrated in FIG. 9, the first terminals 1*x* and the second terminals 1*y* are arranged at spaced internals along the respective edges of the rectangular device area C. Each of the terminals 1*x* and 1*y* is a square shape, with the length W1 of a side being 0.2 mm.

Figure 3A:
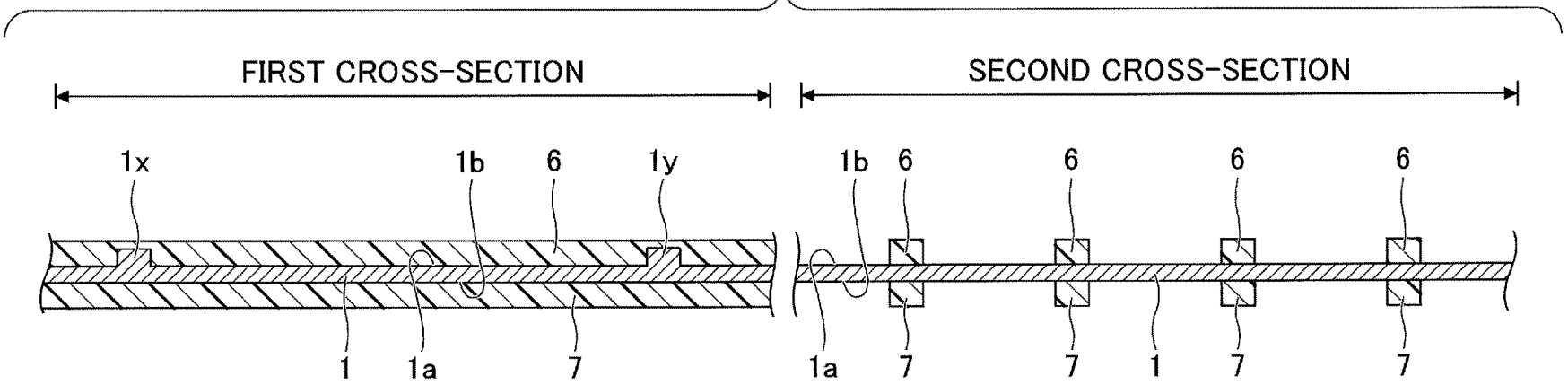
FIGS. 3A and 3B are cross-sectional views of the inductor of the first embodiment during the manufacturing stage.
Figure 10:
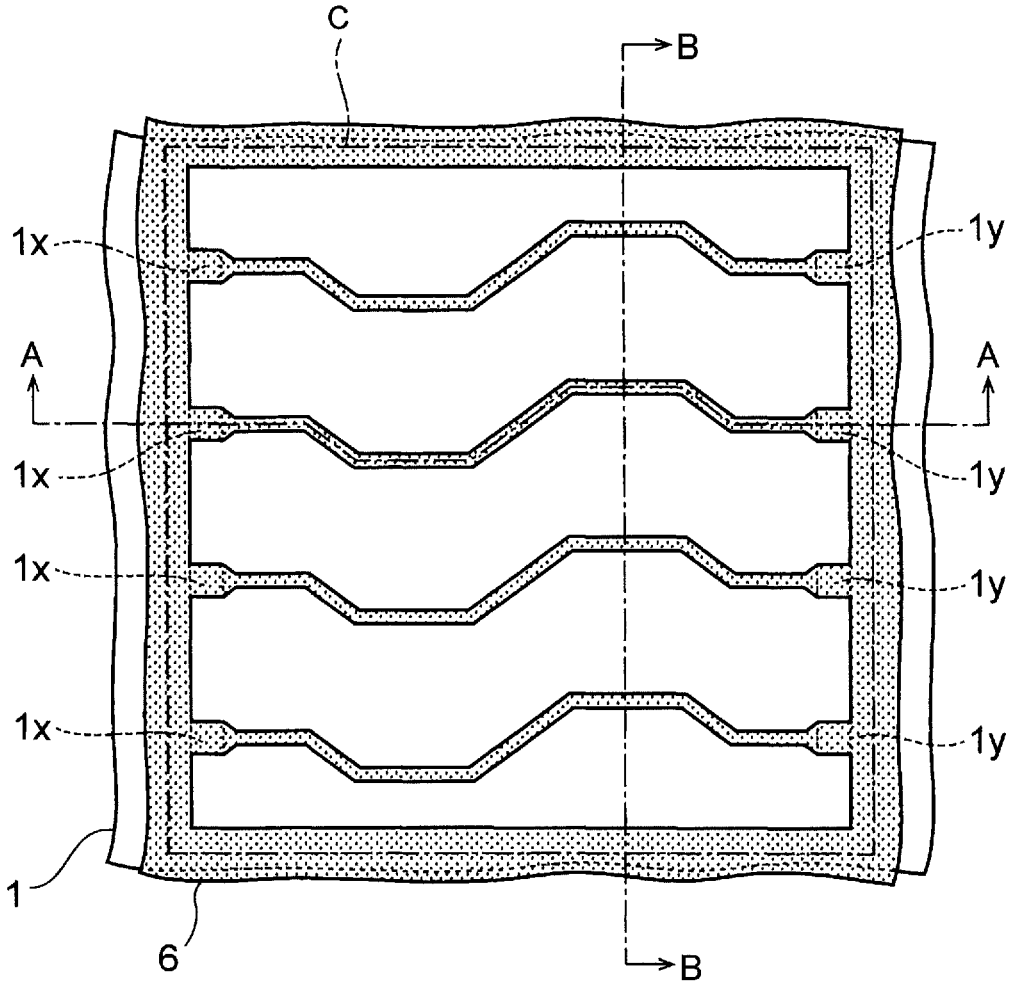
FIG. 10 is a plan view of the inductor of the first embodiment during the manufacturing stage.

As illustrated in FIG. 3A and FIG. 10, a third resist layer 6 is disposed on the front face 1*a* of the metal plate 1, and a fourth resist layer 7 is disposed on the back face 1*b* at the places where the third resist layer 6 is situated.

As illustrated in FIG. 10, the pattern of the third resist layer 6 includes lines extending from the first terminals 1*x* to the second terminals 1*y* in a meandering manner.

Figure 3B:
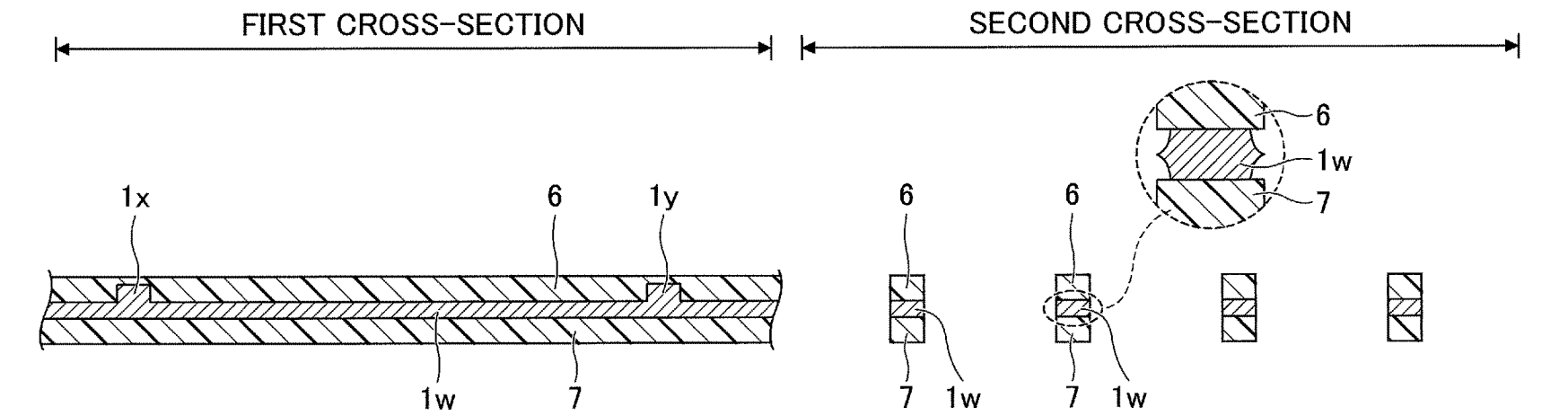

As illustrated in FIG. 3B, the resist layers 6 and 7 are used as masks to perform wet-etching on both faces of the metal plate 1 to pattern the metal plate 1. A plurality of conductors 1*w* are thus formed of the metal plate 1.

Due to the nature of this wet-etching that progresses in an isotropic manner, as illustrated in a dotted-line circle, each conductor 1*w* has lateral projections at the vertical center of the side faces, with the upper and lower faces thereof being flat.

The metal plate 1 may be patterned by stamping or laser processing in place of wet-etching.

The upper faces of the first terminal 1*x* and the second terminal 1*y* are elevated from the surface of the conductor 1*w*.

The resist layers 6 and 7 are then removed.

Figure 11:
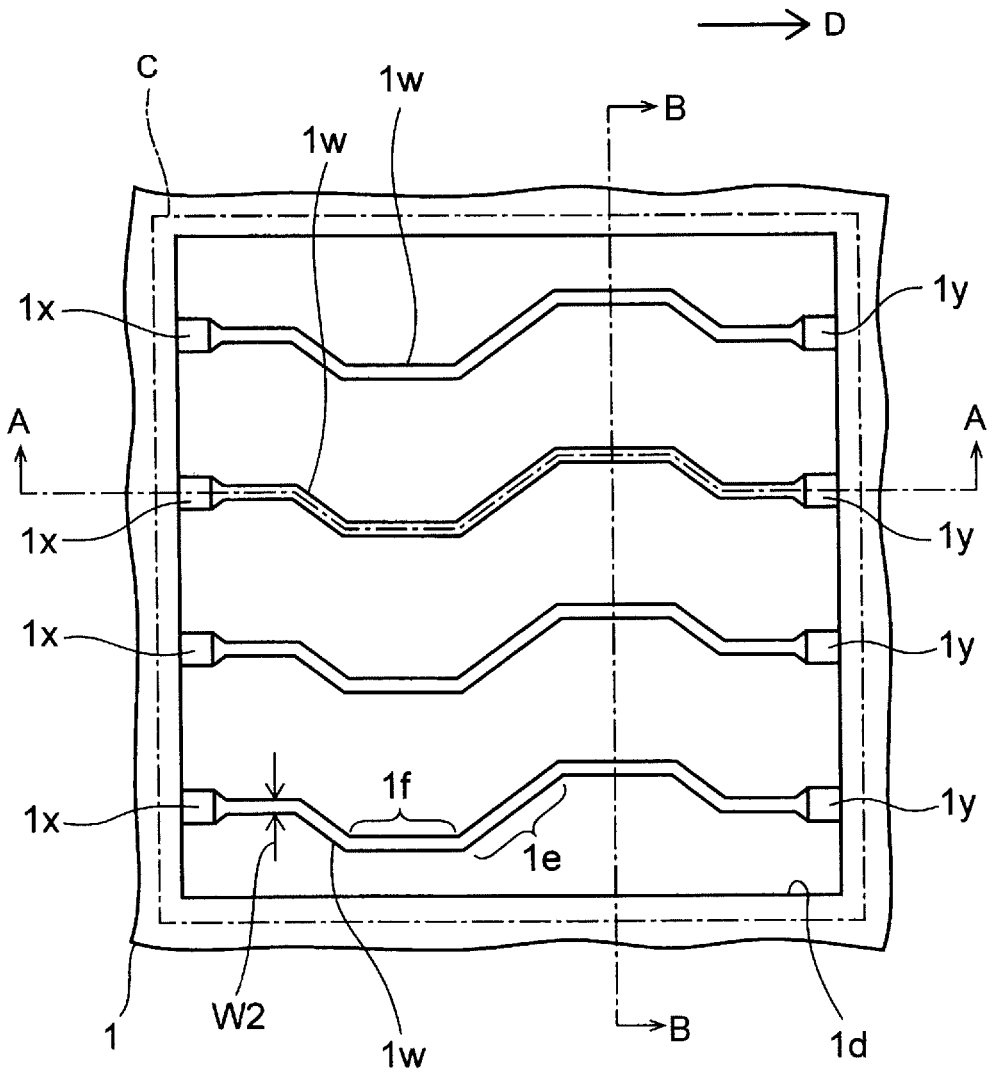
FIG. 11 is a plan view of the inductor of the first embodiment during the manufacturing stage.

FIG. 11 is a plan view of the metal plate 1 after the removal of the resist layers 6 and 7.

As illustrated in FIG. 11, a frame member 1*d* is formed in the device area C. The frame member id supports the plurality of conductors 1*w*. Each conductor 1*w*, which is a conductive line, is comprised of a metal strip meandering in a common extension direction D. Each conductor 1*w* has the first terminal 1*x* at one end and the second terminal 1*y* at the other end.

Each conductor 1*w* includes a meandering part 1*e* and a straight part 1*f*. The straight part 1*f* extends in the extension direction D. The meandering part 1*e* is placed at an angle to the straight part 1*f* in either direction in the plan view. The conductors 1*w* may be comprised of only the meandering parts 1*e*, without having the straight part 1*f*.

A width W2 of each conductor 1*w* is approximately 0.1 mm in this example, although this is not a limiting example.

Figure 4A:
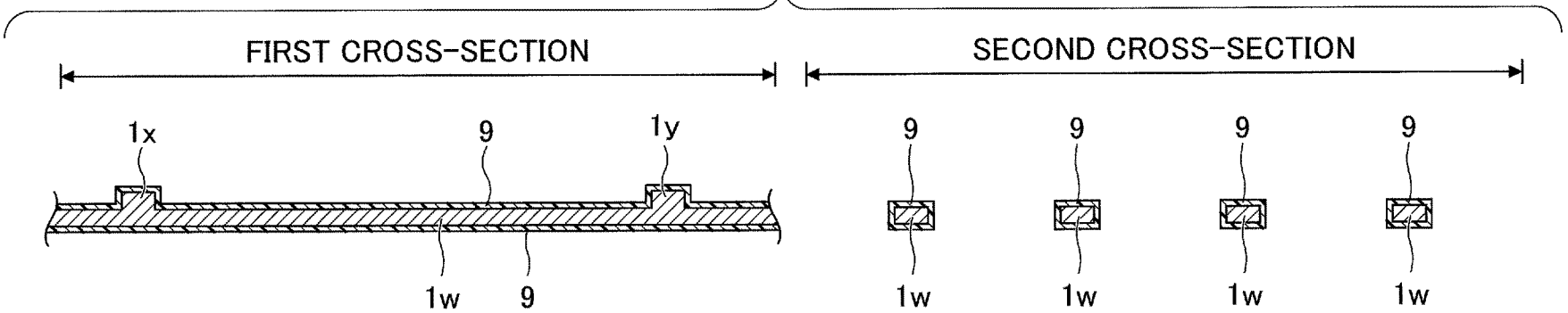
FIGS. 4A and 4B are cross-sectional views of the inductor of the first embodiment during the manufacturing stage.

As illustrated in FIG. 4A, an insulating layer 9 made of an epoxy resin having a permittivity of approximately 1.8 is formed to a thickness of 10 micrometers by electrodeposition coating on the surfaces of the conductors 1*w* and the terminals 1*x* and 1*y*. The insulating layer 9 thus covers, as a coating, all the surfaces of the conductors 1*w* and the terminals 1*x* and 1*y*.

The material of the insulating layer 9 is not limited to an epoxy resin, and may alternatively be a different resin material such as a polyimide resin.

Figure 4B:
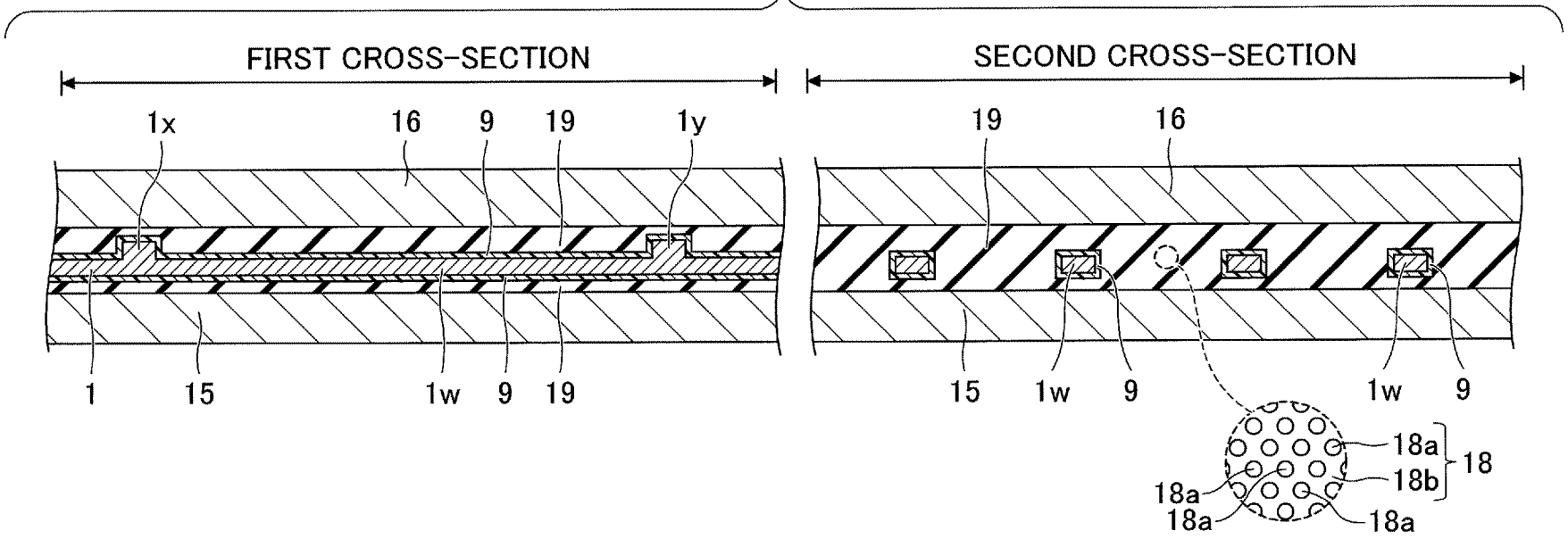

As illustrated in FIG. 4B, the metal plate 1 is placed between a lower mold 15 and an upper mold 16 of a hot press machine. The surroundings of the metal plate 1 are filled with powder 18 obtained by mixing a magnetic powder 18*a* and an insulating resin 18*b*. The powder 18 situated under the metal plate 1 may be tentatively formed into a plate shape before this process step, thereby allowing the metal plate 1 to be placed thereon.

The insulating resin 18*b* is a binder. A thermosetting resin or thermoplastic resin such as an epoxy resin, a polyimide resin, a phenol resin, an acrylic resin, or the like may be used as the insulating resin 18*b*. The magnetic powder 18*a* is not limited to a particular material. A soft magnetic material powder may be used as the magnetic powder 18*a*. Examples of the magnetic powder 18*a* include a carbonyl iron powder, a ferrite powder, and a permalloy powder, for example.

While the illustrated arrangement is kept, the lower mold 15 and the upper mold 16 apply a pressure of approximately 200 MPa to the powder 18 while the powder 18 is heated to approximately 160 degrees Celsius, which mold the powder 18 under high pressure to form a plate-shape magnetic material 19.

The magnetic material 19 formed as described above contains the magnetic powder 18*a* and the insulating resin 18*b*.

As illustrated in a dotted-line circle in FIG. 3B, the side faces of the conductors 1*w* have lateral projections. This shape serves to increase the areas of contact between the conductors 1*w* and the magnetic material 19, thereby providing an increased adhesion strength between the conductors 1*w* and the magnetic material 19.

In this example, the powder 18 is subjected to high-pressure molding to form the magnetic material 19. The method of making the magnetic material 19 is not limited to this example. For example, the metal plate 1 may be placed between two magnetic films to form a multilayer structure, which is then heated to approximately 100 degrees Celsius in a vacuum and subjected to the application of a pressure of approximately 0.8 MPa to turn the magnetic films into the magnetic material 19. Such magnetic films may be made by molding into a sheet a magnetic material obtained by mixing a carbonyl iron powder and an insulating resin serving as a binder. In this case, a heat treatment in which a heating temperature is set to approximately 180 degrees Celsius may be performed for a duration of approximately 1 hour to thermally harden the binder after the magnetic material 19 is formed as described above.

The insulating resin serving as a binder is not limited to a particular material. A thermosetting resin or thermoplastic resin such as an epoxy resin, a polyimide resin, a phenol resin, an acrylic resin, or the like may be used as the insulating resin.

The power mixed into the magnetic film is not limited to the carbonyl iron powder. A soft magnetic material powder such as a ferrite powder or a permalloy powder may be mixed into the magnetic film.

Figure 5A:
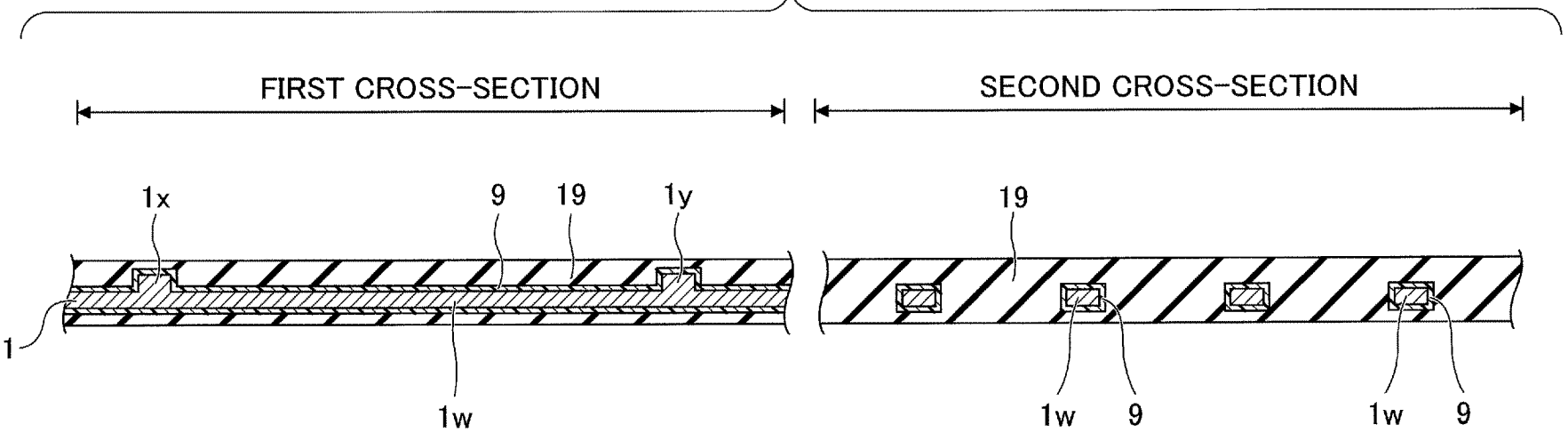
FIGS. 5A and 5B are cross-sectional views of the inductor of the first embodiment during the manufacturing stage.
Figure 12:
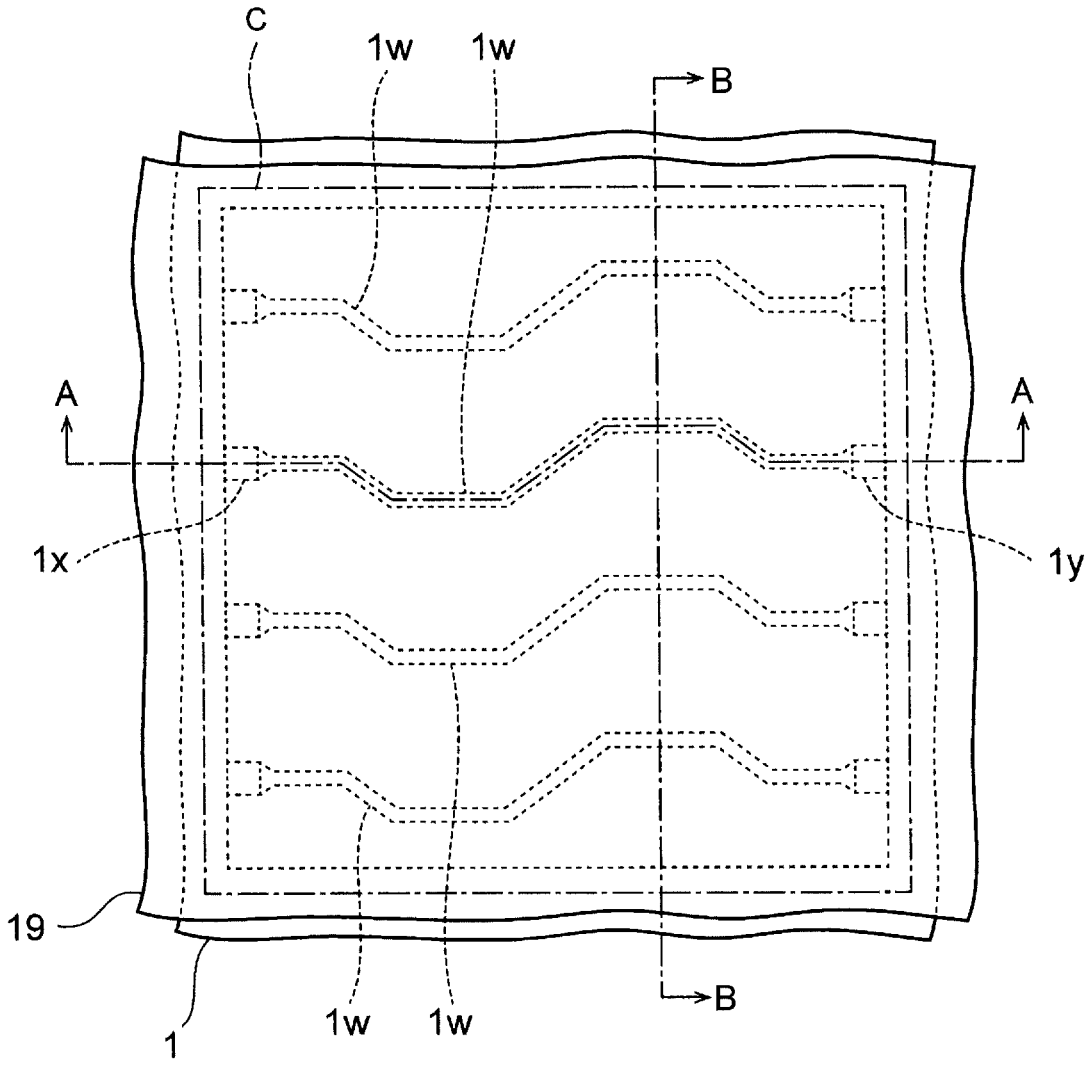
FIG. 12 is a plan view of the inductor of the first embodiment during the manufacturing stage.

As illustrated in FIG. 5A and FIG. 12, the metal plate 1 is taken out of the space between the lower mold 15 and the upper mold 16. It may be noted that the insulating layer 9 is omitted in FIG. 12 for the sake of avoiding the illustration of minute details. The same applies in the case of FIG. 13 and FIG. 14 which will be described later.

Figure 5B:
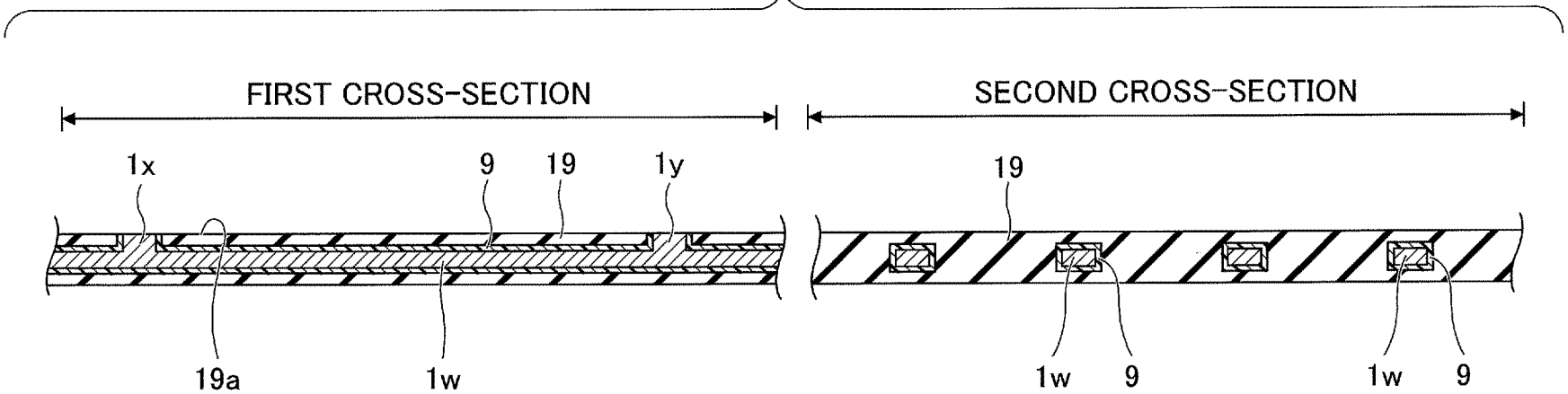
Figure 13:
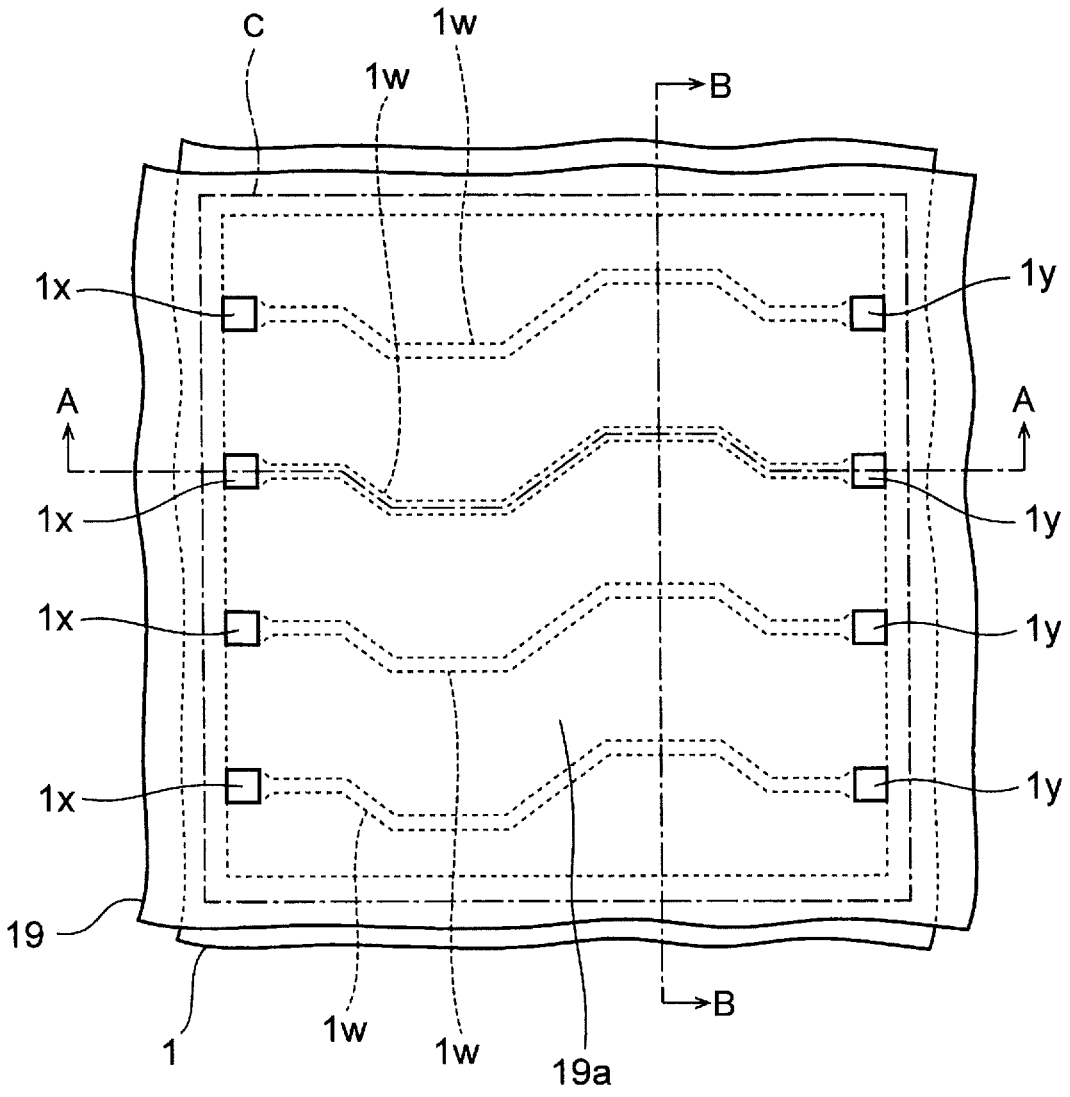
FIG. 13 is a plan view of the inductor of the first embodiment during the manufacturing stage.

As illustrated in FIG. 5B and FIG. 13, brush polishing or abrasive blasting is performed to polish a surface 19*a* of the magnetic material 19, thereby removing the insulating layer 9 and the magnetic material 19 from the top of the terminals 1*x* and 1*y*. As a result, a portion of each of the terminals 1*x* and 1*y* are exposed from the surface 19*a* of the magnetic material 19.

In the present embodiment, the metal plate was etched to a depth halfway through the thickness thereof to form the terminals 1*x* and 1*y* as illustrated in FIG. 2B, so that the terminals 1*x* and 1*y* project upwards from the conductors 1*w*. This arrangement makes it easier to expose the terminals 1*x* and 1*y* from the upper surface of the magnetic material 19.

Figure 6A:
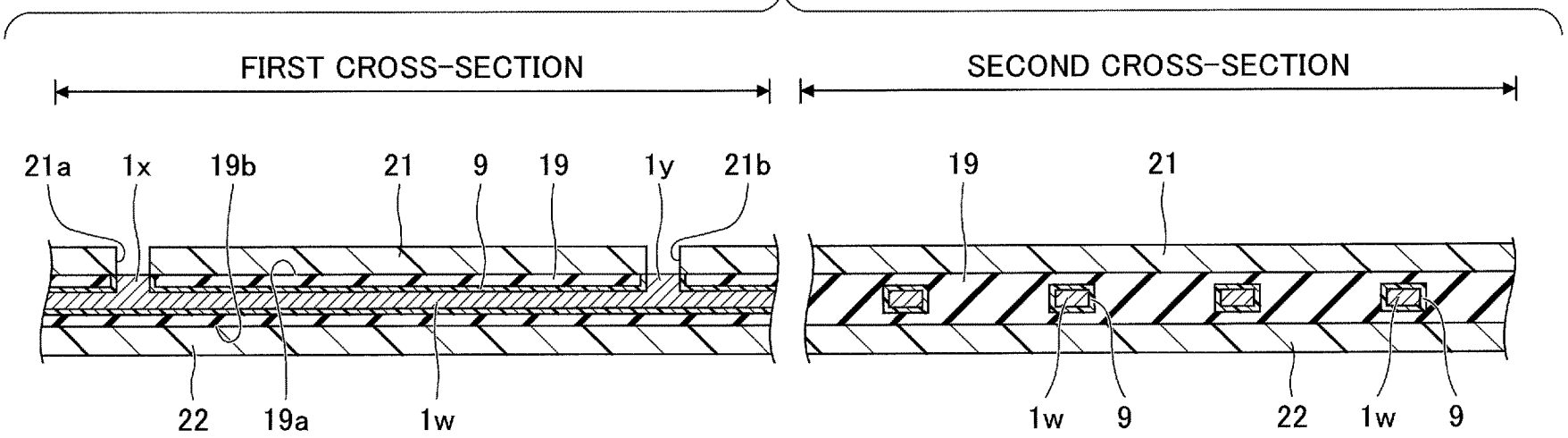
FIGS. 6A and 6B are cross-sectional views of the inductor of the first embodiment during the manufacturing stage.

As illustrated in FIG. 6A, a fifth resist layer 21 having openings 21*a* and 21*b* overlapping the terminals 1*x* and 1*y*, respectively, is disposed on the surface 19*a* of the magnetic material 19. Further, a sixth resist layer 22 is disposed on the back surface 19*b* of the magnetic material 19, so that the sixth resist layer 22 covers the back surface 19*b*.

Figure 6B:
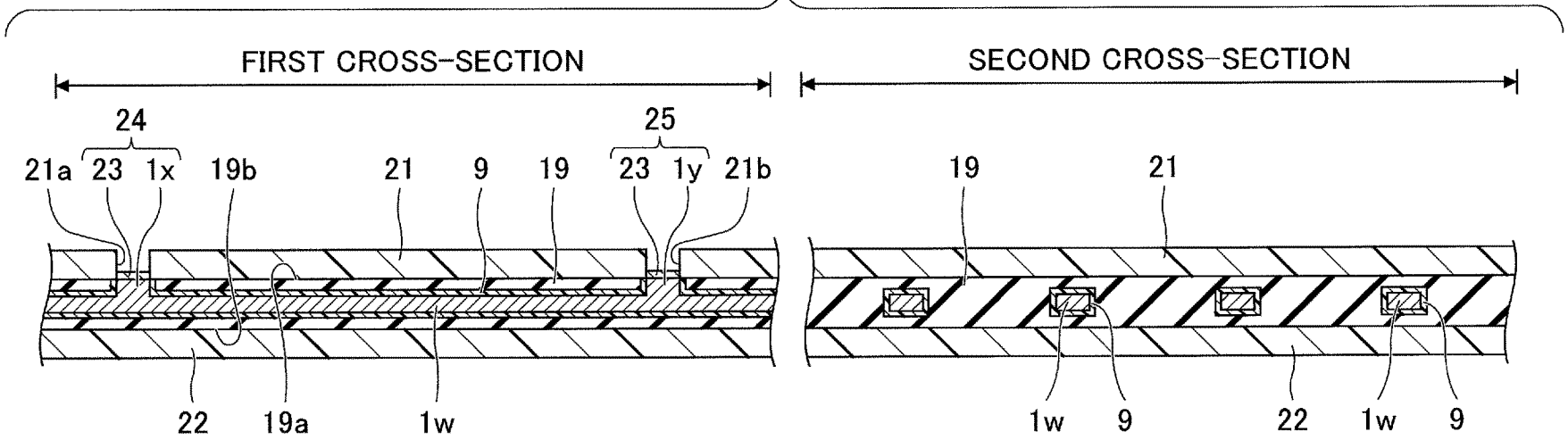

As illustrated in FIG. 6B, electricity is fed to the metal plate 1 to perform electrolytic plating to form a nickel layer and a tin layer in this order on the surfaces of the terminals 1*x* and 1*y* exposed through the openings 21*a* and 21*b*, respectively, thereby forming a metal plating layer 23.

With this arrangement, a first electrode 24 comprised of the first terminal 1*x* and the metal plating layer 23 is formed, and, also, a second electrode 25 comprised of the second terminal 1*y* and the metal plating layer 23 is formed.

The metal plating layer 23 is not limited to a particular thickness. The nickel layer may have a thickness of approximately 2 micrometers, and the tin layer may have a thickness of approximately 5 micrometers, for example.

The metal plating layer 23 not only serves as an oxidation resistant layer for the terminals 1*x* and 1*y*, but also serves to improve the solder wettability of the electrodes 24 and 25. The metal plating layer 23 having such functions may alternatively be a multilayer film comprised of a nickel layer and a gold layer laminated in this order, or a multilayer film comprised of a silver layer and a tin layer laminated in this order.

Figure 7A:
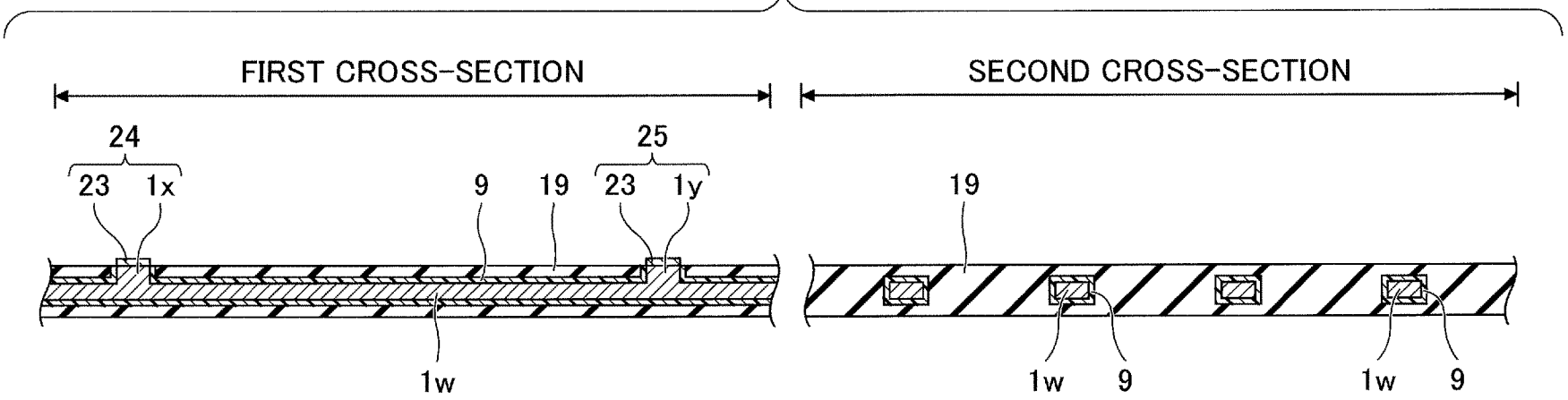
FIGS. 7A and 7B are cross-sectional views of the inductor of the first embodiment during the manufacturing stage.

As illustrated in FIG. 7A, the fifth resist layer 21 and the sixth resist layer 22 are removed.

Figure 7B:
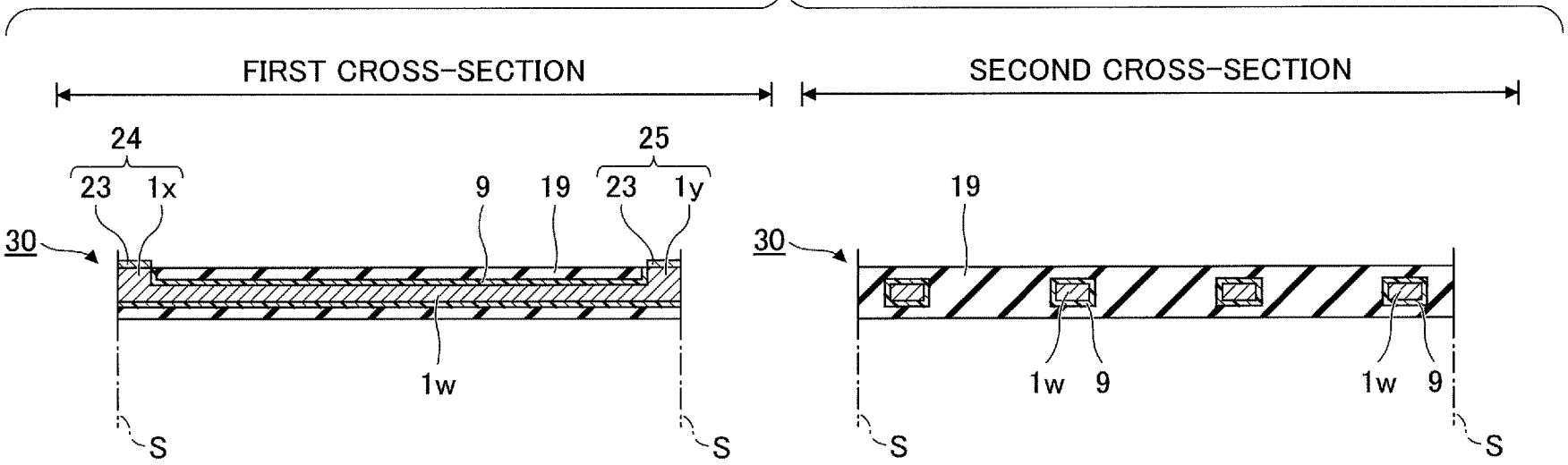
Figure 14:
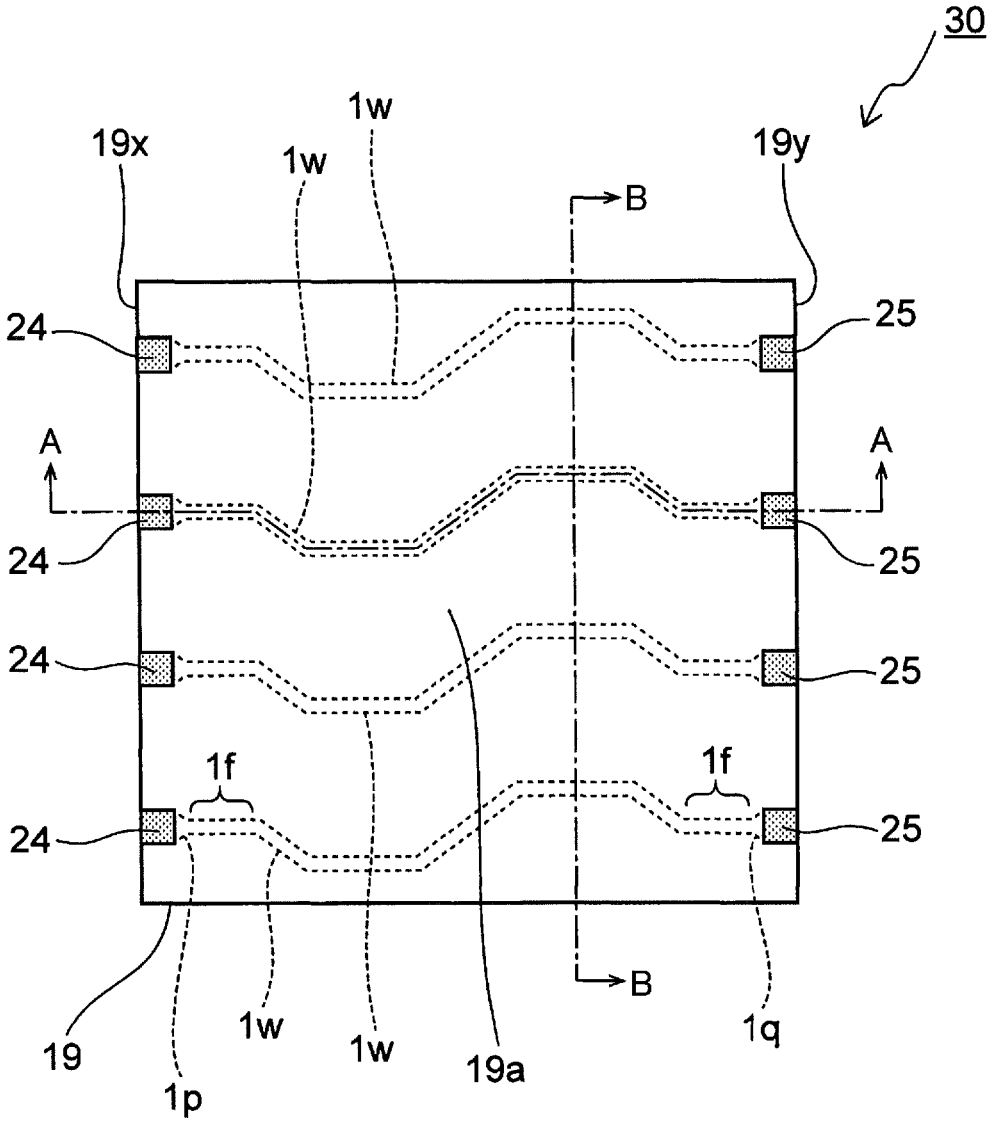
FIG. 14 is a plan view of the inductor of the first embodiment during the manufacturing stage.

As illustrated in FIG. 7B and FIG. 14, the metal plate 1 and the magnetic material 19 are cut along cut lines S, with which the basic structure of an inductor 30 of the present embodiment is completed in final form.

As illustrated in FIG. 14, the magnetic material 19 is a square shape (or rectangular shape) with the length of a side being approximately 2.5 mm in the plan view. The surface 19*a* has a first edge 19*x* and a second edge 19*y* opposite to each other. The first electrodes 24 are exposed on the first edge 19*x*, and the second electrodes 25 are exposed on the second edge 19*y*.

The conductors 1*w*, which are made of the metal plate 1, extend from the first edge 19*x* to the second edge 19*y* in the same direction. The conductors 1*w* are arranged to meander in the plan view. This arrangement serves to increase the inductance of the conductors 1*w* relative to the case in which the conductors 1*w* are straight lines.

The magnetic material 19 has a certain degree of electrical conductivity. Covering the surfaces of the conductors 1*w* with the insulating layer 9 (see FIG. 7B), however, serves to prevent the conductors 1*w* from being short-circuited through the magnetic material 19.

In this example, connection parts 1*p* connecting the straight parts 1*f* of the conductors 1*w* and the first electrodes 24 have a width increasing toward the first electrodes 24. Similarly, connection parts 1*q* between the straight parts 1*f* and the second electrodes 25 have a width increasing toward the second electrodes 25. This arrangement reduces mechanical stress applied to the connection parts 1*p* and 1*q* after the inductor 30 is mounted on a circuit board (not shown), which prevents the connection parts 1*p* and 1*q* from having cracks, thereby increasing the reliability of the inductor 30.

Figure 15A:
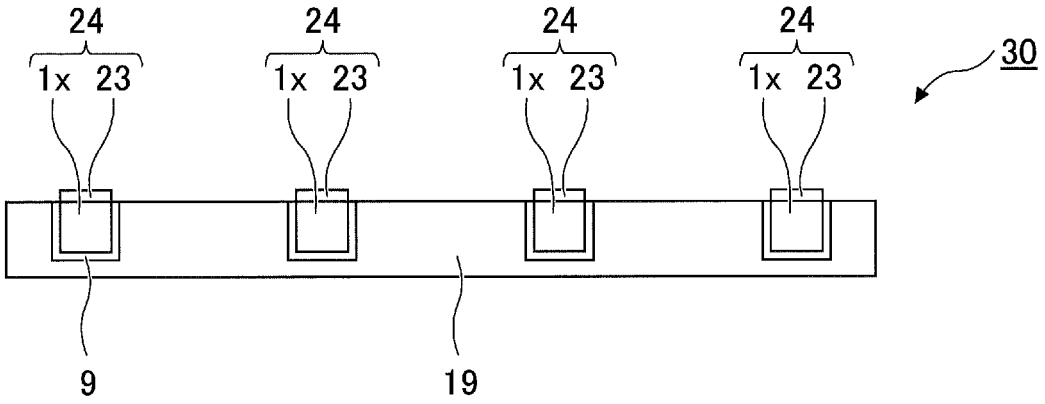
FIGS. 15A and 15B are side-elevation views of the inductor of the first embodiment as viewed from the direction toward which the first electrodes are situated and from the direction toward which the second electrodes are situated, respectively.
Figure 15B:
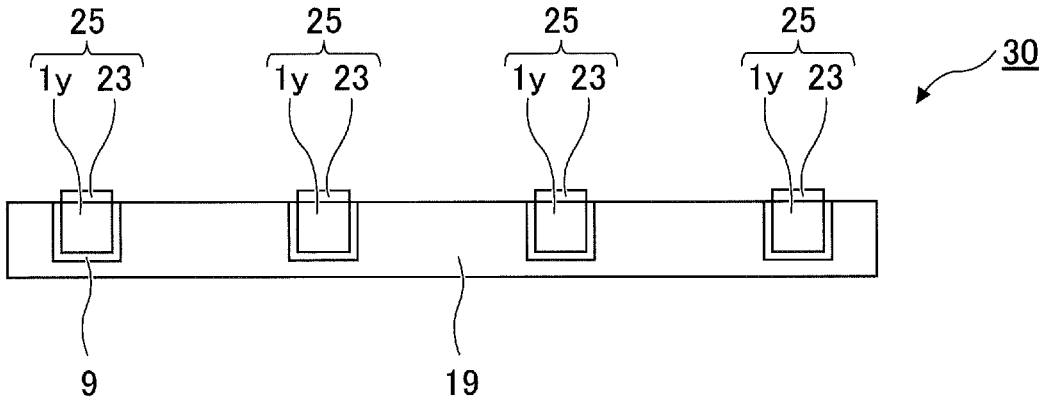

FIG. 15A is a side elevation view of the inductor 30 illustrating the side where the first electrodes 24 are situated. FIG. 15B is a side elevation view of the inductor 30 illustrating the side where the second electrodes 25 are situated.

As illustrated in FIGS. 15A and 15B, the side faces of the terminals 1*x* and 1*y* constituting the electrodes 24 and 25, respectively, are exposed at the side faces of the inductor 30.

Figure 16:
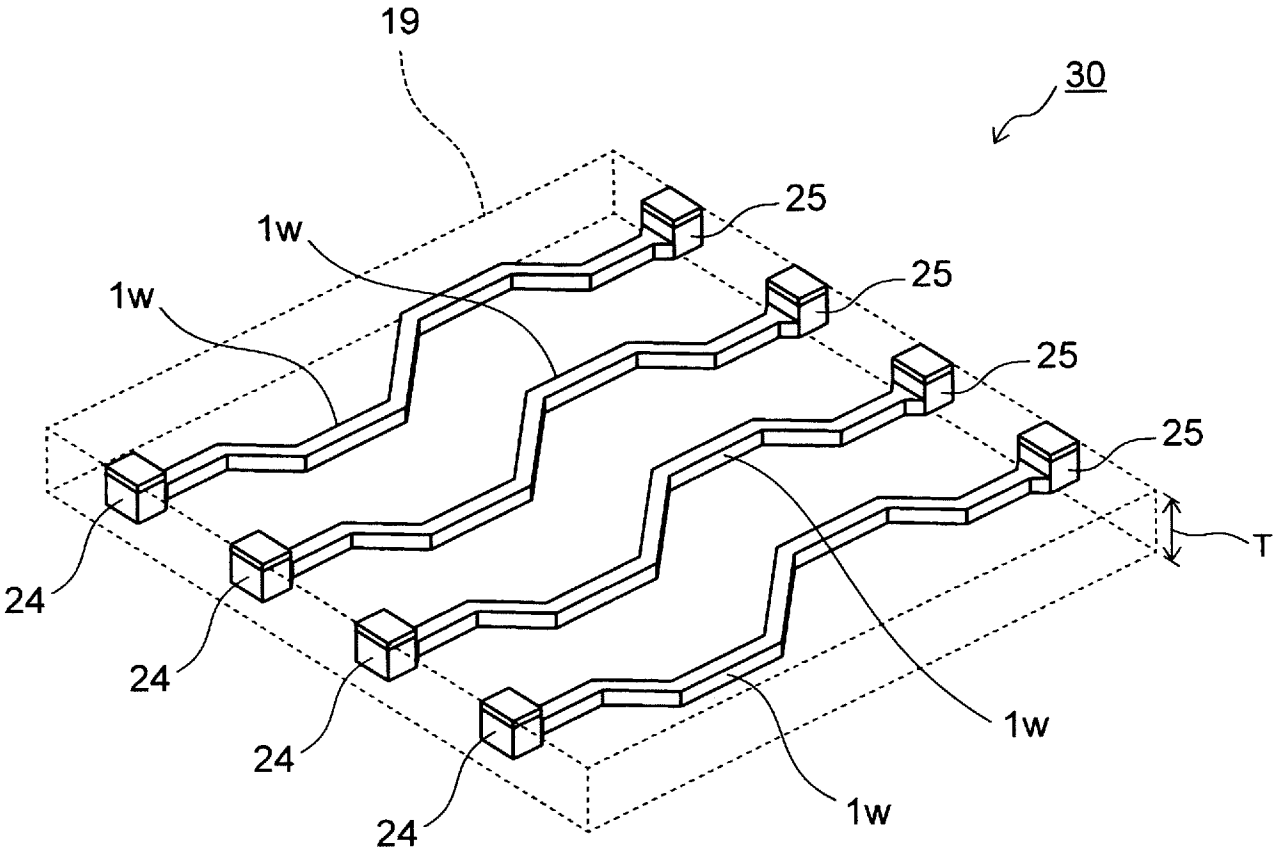
FIG. 16 is an axonometric view of the inductor of the first embodiment.

FIG. 16 is an axonometric view of the inductor 30.

As illustrated in FIG. 16, the inductor 30, which has a plate shape or cuboid shape outer appearance, has the conductors 1*w* embedded in the magnetic material 19. The inductance of each conductor 1*w* is adjustable by changing the permeability of the magnetic material 19, the shape of the conductor 1*w*, etc.

In the present embodiment, making the conductors 1*w* from the metal plate 1 and molding the magnetic material 19 into a plate shape enable the reduction of the thickness T of the inductor 30 to approximately 0.3 mm, which contributes to the reduction of size of an electronic device having the inductor 30.

As in the examples illustrated in FIG. 14 and FIG. 16, the shapes of the meandering conductors 1*w* may be made to match each other, which prevents the adjacent conductors 1*w* from being in contact with each other even when the intervals between the adjacent conductors 1*w* are shortened. This arrangement thus allows the intervals between the adjacent conductors 1*w* to be shortened to reduce the size of the inductor 30.

Figure 17B:
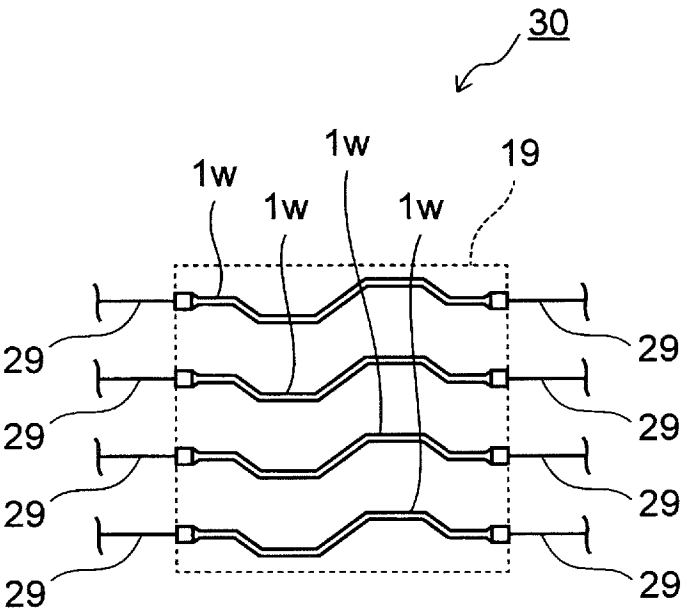
FIGS. 17A and 17B are plan views of the inductor schematically illustrating its usages.
Figure 17A:
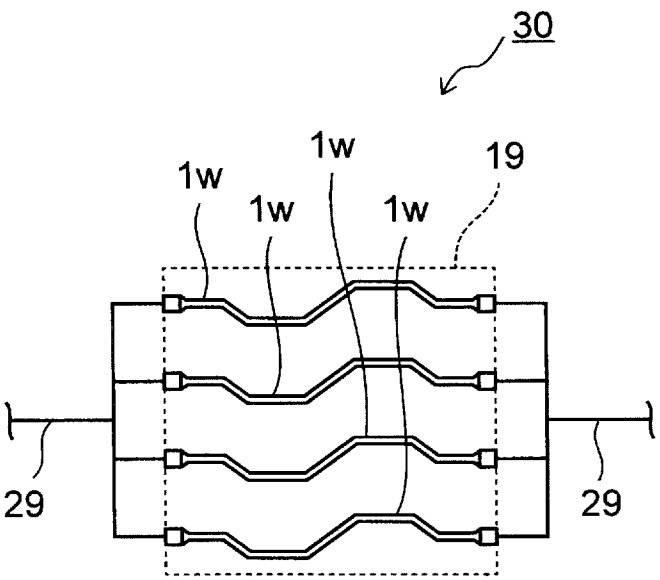

FIGS. 17A and 17B are plan views of the inductor 30 schematically illustrating the usages of the inductor 30.

In the example illustrated in FIG. 17A, the conductors 1*w* of the inductor 30 are coupled in parallel via interconnections 29. This arrangement reduces the total resistance of the inductor 30, which enables the use of the inductor 30 for large-current purposes as in a power-supply circuit for supplying power to a CPU.

As illustrated in FIG. 17B, interconnections 29 may be separately coupled to the respective conductors 1*w*, thereby allowing each of the conductors 1*w* to be used independently.

Figure 18:
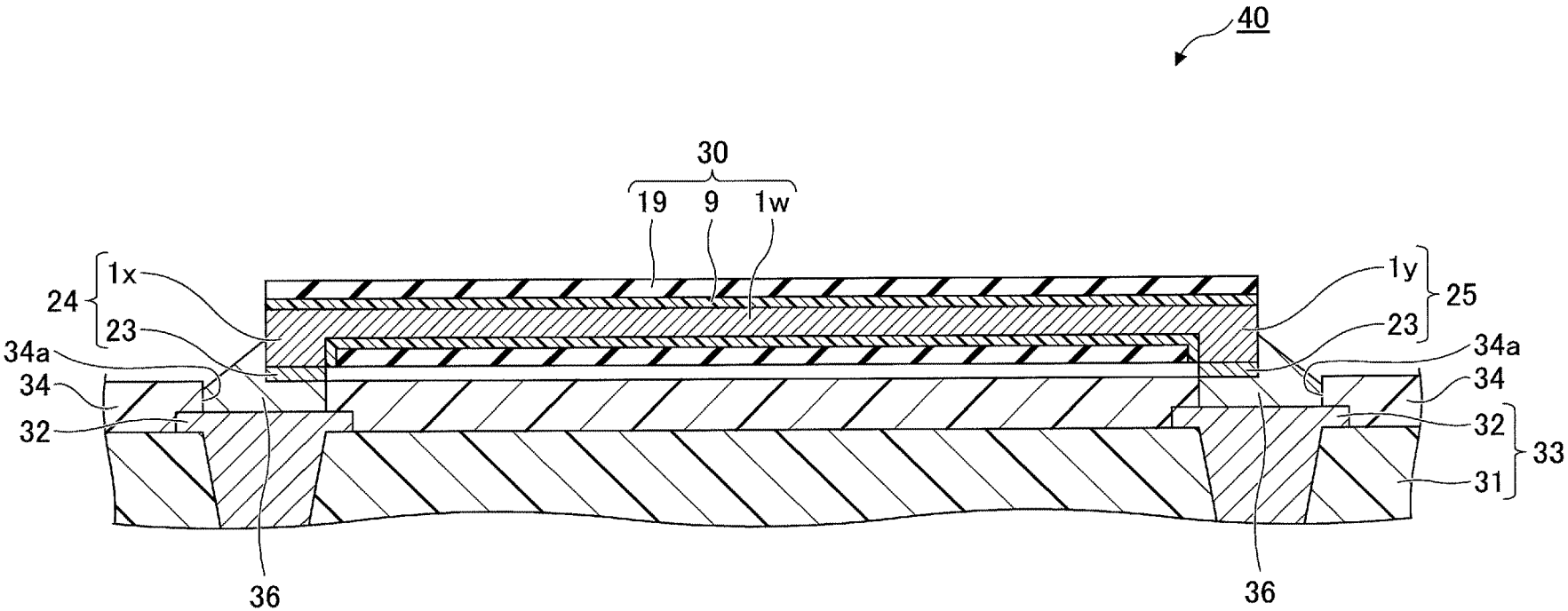
FIG. 18 is a cross-sectional view of an electronic device having the inductor of the first embodiment.

FIG. 18 is a cross-sectional view of an electronic device having the inductor 30.

An electronic device 40 may be a multiphase DC-DC converter for supplying electric power to a CPU, for example, and includes the inductor 30 and a circuit substrate 33.

The circuit substrate 33 includes an insulating layer 31 and electrode pads 32 disposed thereon. A solder resist layer 34 having openings 34*a* overlapping the electrode pads 32 is disposed on the insulating layer 31. The electrodes 24 and 25 of the inductor 30 are coupled to the electrode pads 32 via solder 36 in the openings 34*a*.

In the present embodiment, the end face and side face of the first electrode 24 are exposed at the surfaces of the magnetic material 19, and the end face and side face of the second electrode 25 are also exposed at the surfaces of the magnetic material 19 Because of this, the solder 36 creeps upward from the end faces of the electrodes 24 and 25 to the side faces of the electrodes 24 and 25 to form solder meniscus. This increases the contact area between the electrodes 24 and 25 and the solder and also the adhesion strength between the electrodes 24 and 25 and the solder 36, thereby contributing to the improvement of reliability of the electronic device 40.

Further, the present embodiment contributes to the thinning of the inductor 30 as was previously described, thereby enabling the size reduction of the electronic device 40.

Embedding the conductors 1*w* in a single mass of the magnetic material 19 makes it easier to reduce the mounting area compared to the case in which the conductors 1*w* are mounted one by one on the circuit substrate 33. The size of the electronic device 40 can thus be further reduced.

[Variations of First Embodiment]

Variations of the first embodiment are directed to the modification of shape of conductors constituting an inductor. In connection with the variations of the first embodiment, a description of the same or similar constituent elements as those of the previously provided descriptions may be omitted as appropriate.

Figure 19C:
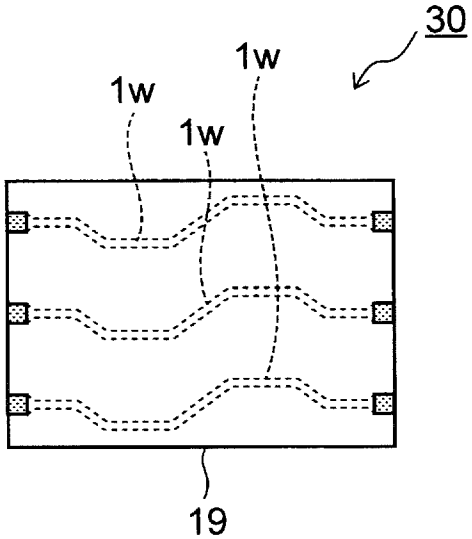
FIGS. 19A through 19C are plan views illustrating variations of conductors in the inductor of the first embodiment.
Figure 19B:
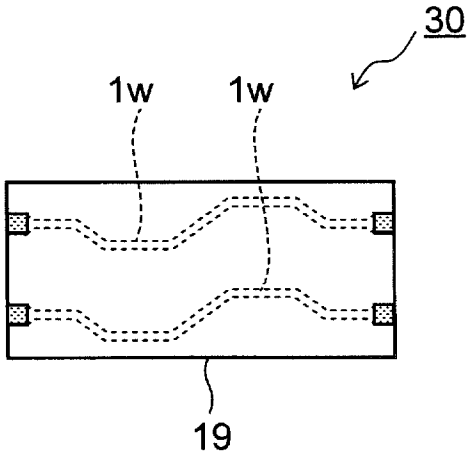
Figure 19A:
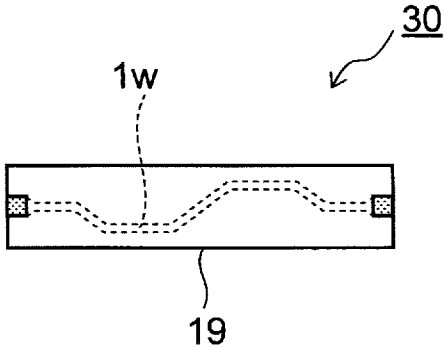

FIG. 19A is a plan view of an inductor in which the number of conductors is one. FIG. 19B is a plan view of an inductor in which the number of conductors is two. FIG. 19C is a plan view of an inductor in which the number of conductors is three.

The inductor 30 of the first embodiment is configured such that the number of conductors 1*w* is four. The number of conductors 1*w* may alternatively be one, two, and three as illustrated in the plan views of FIGS. 19A, 19B, and 19C, respectively. The inductor 30 may instead be configured such that the number of conductors 1*w* is five or more.

In the first embodiment, the conductors 1*w* are arranged to meander between the electrodes 24 and 25. Alternatively, the conductors 1*w* may be arranged to extend straight between the electrodes 24 and 25 as illustrated in the plan view of FIG. 20A to reduce the inductance of each conductor 1*w*.

Figure 20B:
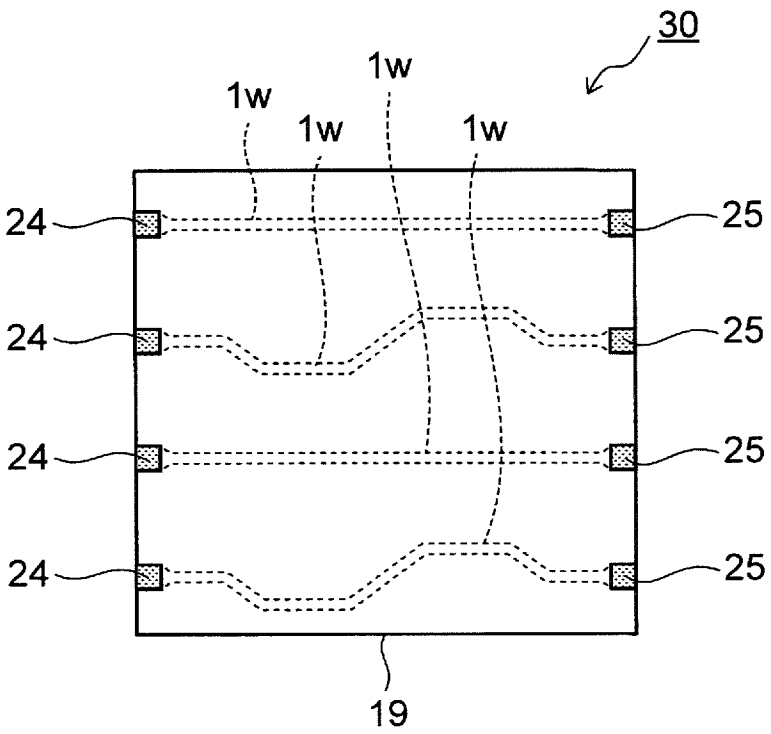
FIGS. 20A and 20B are plan views illustrating variations of conductors in the inductor of the first embodiment.
Figure 20A:
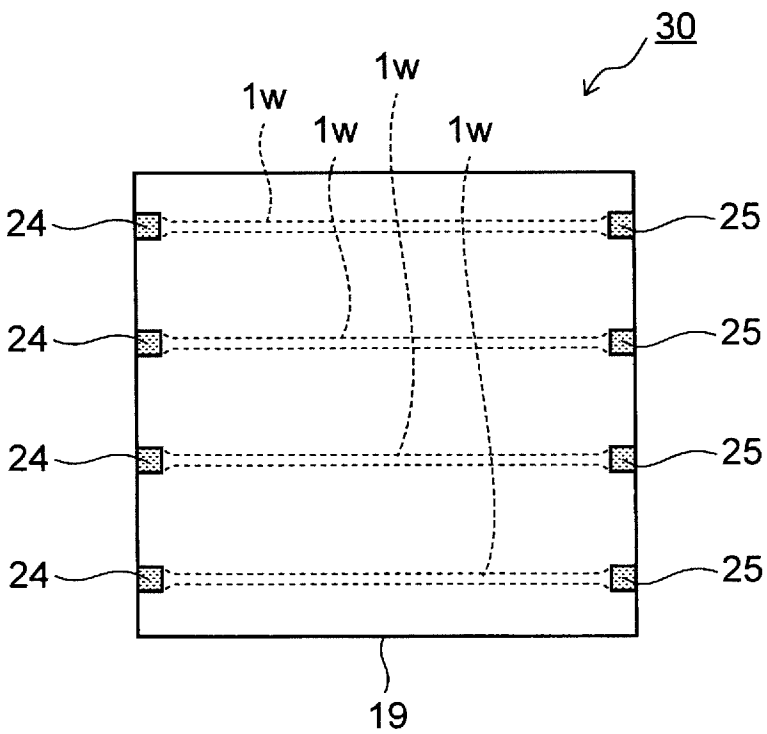

Alternatively, as illustrated in the plan view of FIG. 20B, meandering conductors 1*w* and straight conductors 1*w* may be mixed in the same inductor 30. Such an arrangement allows inductors 30 having conductors 1*w* to have different inductances, thereby providing a broader area of application for the inductor 30.

Figure 21:
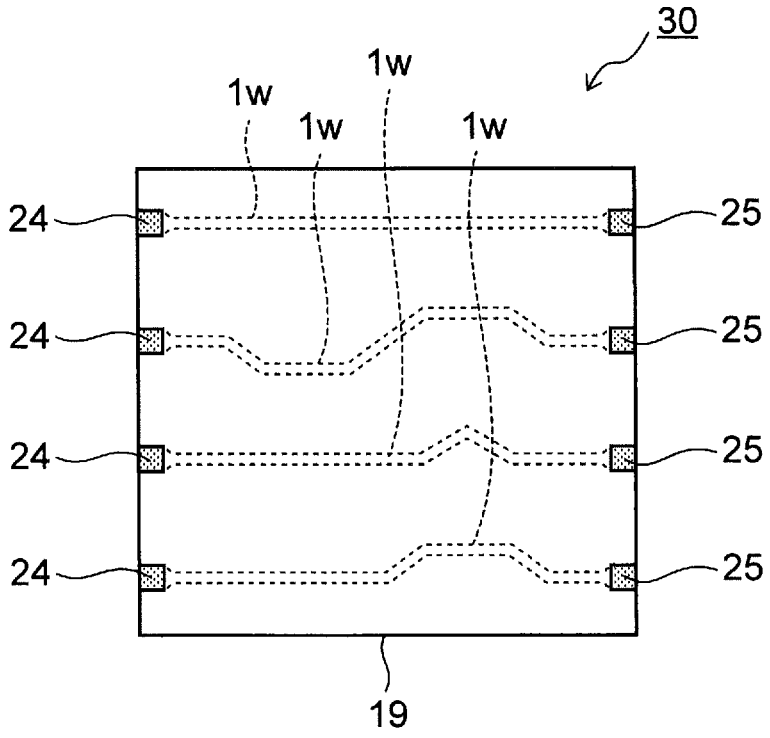
FIG. 21 is a plan view illustrating a variation of conductors in the inductor of the first embodiment.

Further, the conductors 1*w* may have different meandering shapes as illustrated in the plan view of FIG. 21.

The variations described by referring to FIG. 19 through FIG. 21 are not only applicable to the inductor 30, but also applicable to inductors 30A, 30B, 30C, 30D, and 30E, which will be described later.

Second Embodiment

The second embodiment is directed to an example in which the height of the first and second electrodes is higher than that of the first embodiment. In connection with the second embodiment, a description of the same or similar constituent elements as those of the previously provided descriptions may be omitted as appropriate.

The first and second electrodes appear only in the first cross-section, and do not appear in the second cross-section. In consideration of this, a description of the second embodiment will be given by referring to plan views and cross-sectional views showing the first cross-section taken along the line A-A.

Figure 22A:
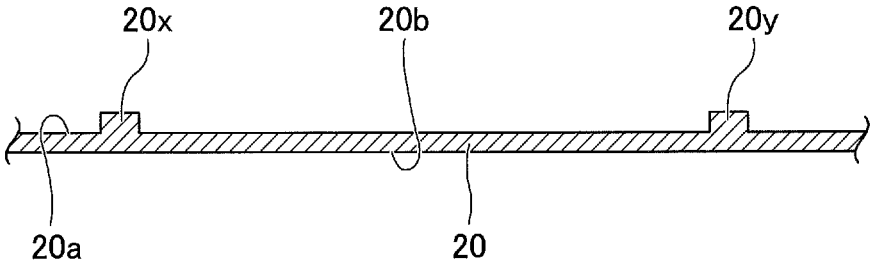
FIGS. 22A through 22C are cross-sectional views of an inductor of a second embodiment during the manufacturing stage.

A metal plate 20 having the same plan shape as the metal plate 1 illustrated in FIG. 1 is prepared. Process steps similar to those described by referring to FIGS. 2A and 2B and FIG. 8 with respect to the first embodiment are then performed, followed by removing the resist layers 2 and 3. As illustrated in the cross-sectional view of FIG. 22A, thus, a third terminal 20*x* and a fourth terminal 20*y* are formed on the metal plate 20 to be elevated from a surface 20*a* thereof. The plan view corresponding to FIG. 22A is the same as FIG. 9. The material and thickness of the metal plate 20 may be the same as or similar to those of the metal plate 1.

Figure 22B:
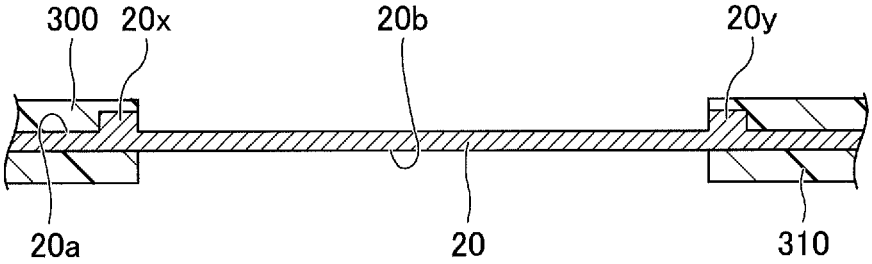
Figure 23:
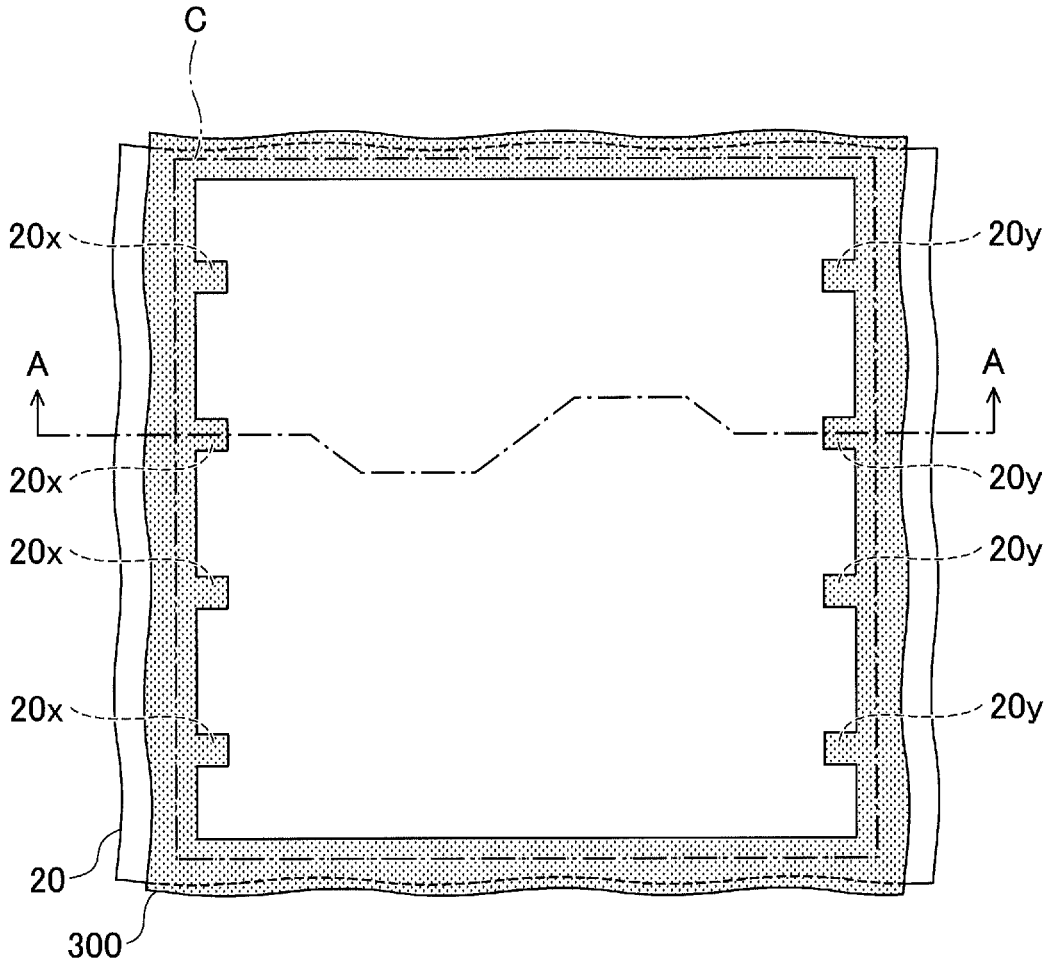
FIG. 23 is a plan view of the inductor of the second embodiment during the manufacturing stage.

As illustrated in the cross-sectional view of FIG. 22B and in the plan view of FIG. 23, a seventh resist layer 300 is formed on the surface 20*a* of the metal plate 20. To be more specific, the seventh resist layer 300 is disposed on the surface 20*a* of the metal plate 20 such that the seventh resist layer 300 covers the third terminals 20*x* and the fourth terminals 20*y* as well as the outer perimeter area of the surface 20*a* of the metal plate 20 situated outside the third terminals 20*x* and the fourth terminals 20*y*. Moreover, an eighth resist layer 310 is disposed on a back surface 20*b* of the metal plate 20 at the places overlapping the seventh resist layer 300 in the plan view.

Figure 22C:
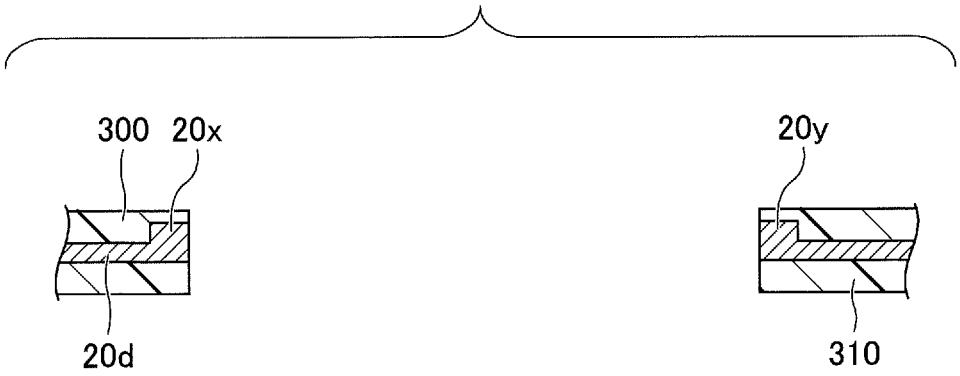

As illustrated in FIG. 22C, the resist layers 300 and 310 are used as masks to perform wet-etching on both surfaces of the metal plate 20 so as to pattern the metal plate 20. The metal plate 20 may be patterned by stamping or laser processing in place of wet-etching.

The resist layers 300 and 310 are then removed. As illustrated in the plan view of FIG. 24, a frame member 20*d* having the third terminals 20*x* and the fourth terminals 20*y* attached thereto is obtained in the device area C. The third terminals 20*x* and the fourth terminals 20*y* are arranged at spaced internals along the respective edges of the rectangular device area C similarly to the first embodiment. The third terminals 20$x$ and the fourth terminals 20$y$ are a squire shape with the length W3 of a side being approximately 0.2 mm, for example. The thickness of the frame member 20$d$ is approximately 0.1 mm, for example. The thickness of the third terminals 20$x$ and the fourth terminals 20$y$ is approximately 0.2 mm (which is the same as the thickness of the metal plate 20 before the etching).

A metal plate 10 having the same plan shape as the metal plate 1 illustrated in FIG. 1 is prepared. Process steps similar to those described by referring to FIGS. 3A and 3B and FIG. 8 through FIG. 11 are then performed without performing the process steps described by referring to FIGS. 2A and 2B with respect to the first embodiment. Consequently, as illustrated in the plan view of FIG. 25, a structure having conductors 10$w$ supported by a frame member 10$d$ is made in the device area C.

Each conductor 10$w$, which is a conductive line, is comprised of a metal strip meandering in a common extension direction D. Each conductor 10$w$ has the first terminal 10$x$ at one end and the second terminal 10$y$ at the other end. Each conductor 10$w$ includes a meandering part 10$e$ and a straight part 10$f$. The straight part 10$f$ extends in the extension direction D. The meandering part 10$e$ is placed at an angle to the straight part 10$f$ in either direction in the plan view. The conductors 10$w$ may be comprised of only the meandering parts 10$e$, without having the straight part 10$f$.

Connecting portions between the conductors 10$w$ and the first terminals 10$x$ may have a width increasing toward the first terminals 10$x$ from the conductors 10$w$. Similarly, connecting portions between the conductors 10$w$ and the second terminals 10$y$ may have a width increasing toward the second terminals 10$y$ from the conductors 10$w$.

The width W4 of the first terminals 10$x$ and the second terminals 10$y$ is not limited to a particular width. The width W4 may be set to approximately 0.2 mm, for example. The width W5 of each conductor 10$w$ is not limited to a particular width. The width W5 may be set to approximately 0.1 mm, for example. Unlike the first embodiment, the frame member 10$d$ and the conductors 10$w$ do not have a reduced thickness. The first terminals 10$x$ and the second terminals 10$y$ as well as the frame member 10$d$ and the conductors 10$w$ have the same thickness (e.g., approximately 0.2 mm).

Figure 24:
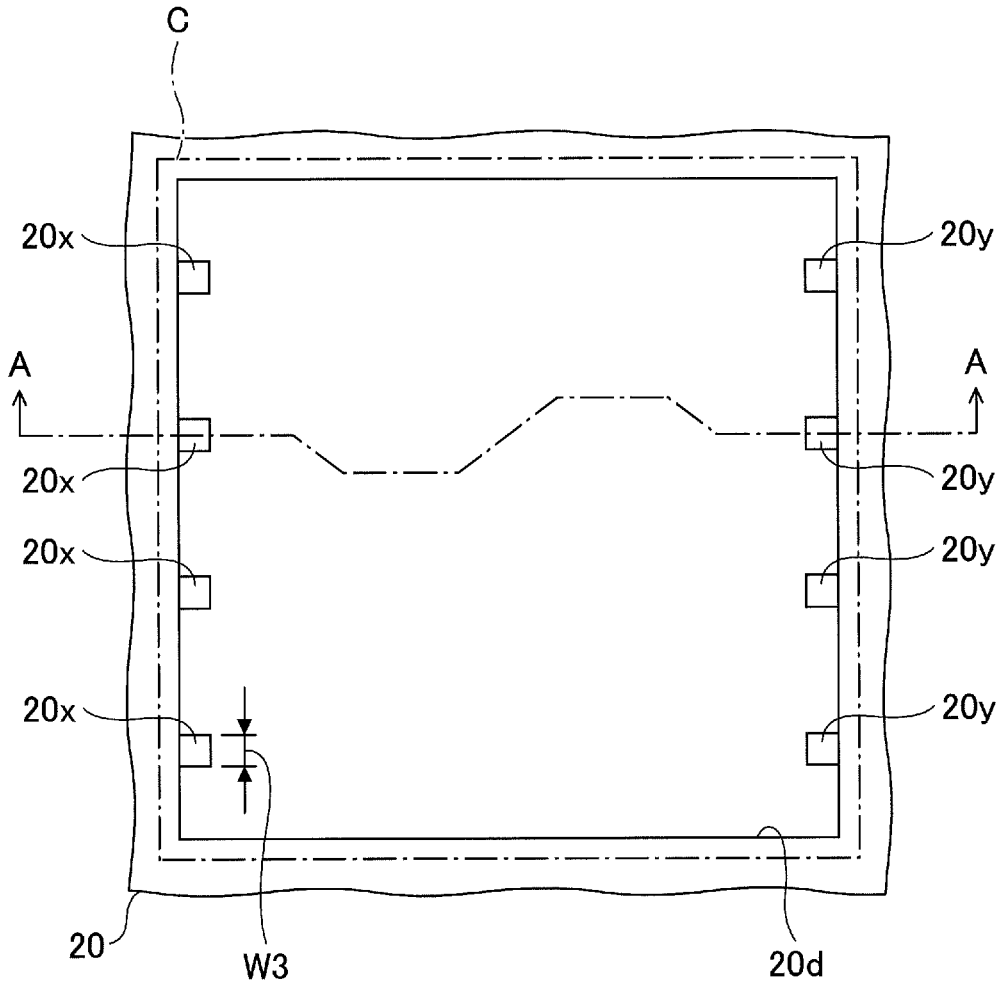
FIG. 24 is a plan view of the inductor of the second embodiment during the manufacturing stage.
Figure 25:
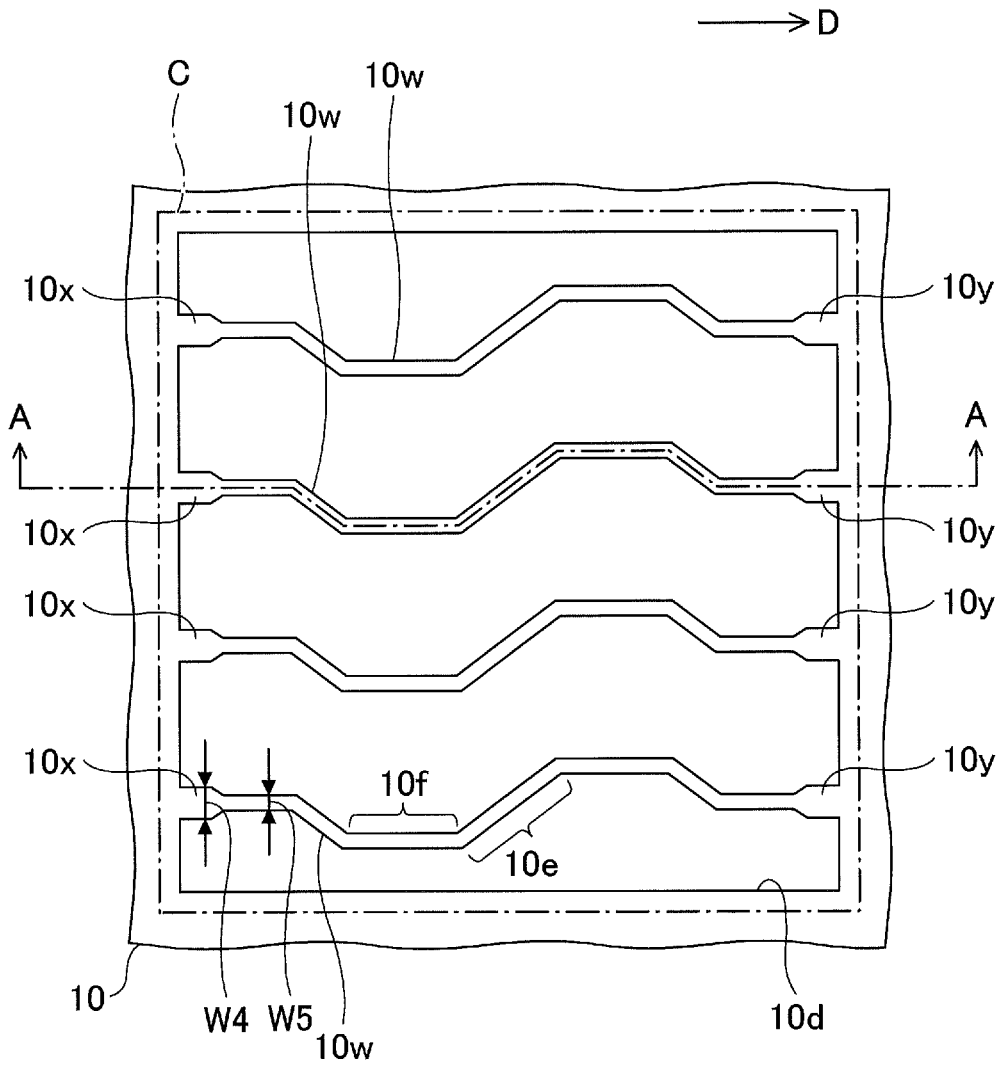
FIG. 25 is a plan view of the inductor of the second embodiment during the manufacturing stage.
Figure 26A:
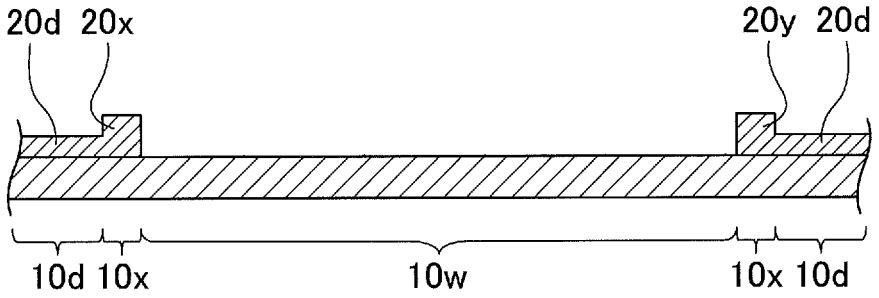
FIGS. 26A through 26C are cross-sectional views of the inductor of the second embodiment during the manufacturing stage.

As illustrated in the cross-sectional view of FIG. 26A, the structure illustrated in FIG. 24 is stacked on, and bonded to, the structure illustrated in FIG. 25. The third terminals 20$x$ and the fourth terminals 20$y$ become elevated portions bonded to a flat surface of the conductors 10$w$. Bonding is made by using diffusion bonding, solder bonding, etc. A conductive paste (e.g., silver paste) may be used in place of solder. Diffusion bonding is a bonding technique that brings two materials in contact with each other, and applies pressure causing as less plastic deformation as possible at an elevated temperature lower than the melting temperature of the materials, thereby causing atoms to be diffused at the bonded surfaces. Diffusion bonding may be performed by applying heat and pressure in the vacuum, for example.

Figure 26B:
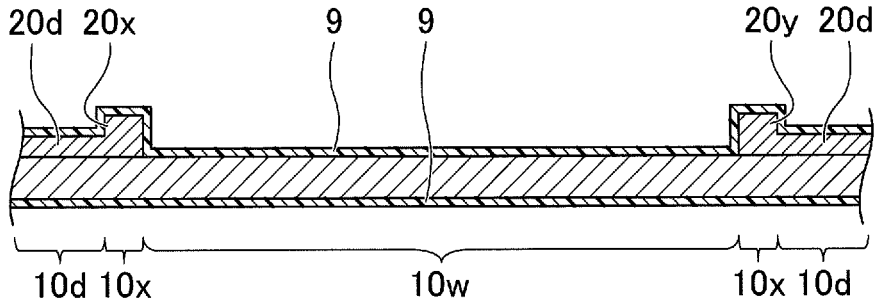

As illustrated in the cross-sectional view of FIG. 26B, the insulating layer 9 covers all the surfaces of the structure illustrated in FIG. 25 and the structure illustrated in FIG. 24, except for the bonding surfaces, similarly to the first embodiment shown in FIG. 4A. To be more specific, the insulating layer 9 made of an epoxy resin having a permittivity of approximately 1.8 is formed by the electrodeposition coating to a thickness of approximately 10 micrometers on the exposed surfaces of the frame member 10$d$, the first terminals 10$x$, the second terminals 10$y$, the conductors 10$w$, the frame member 20$d$, the third terminals 20$x$, and the fourth terminals 20$y$. The material of the insulating layer 9 is not limited to an epoxy resin, and may alternatively be a different resin material such as a polyimide resin.

Figure 26C:
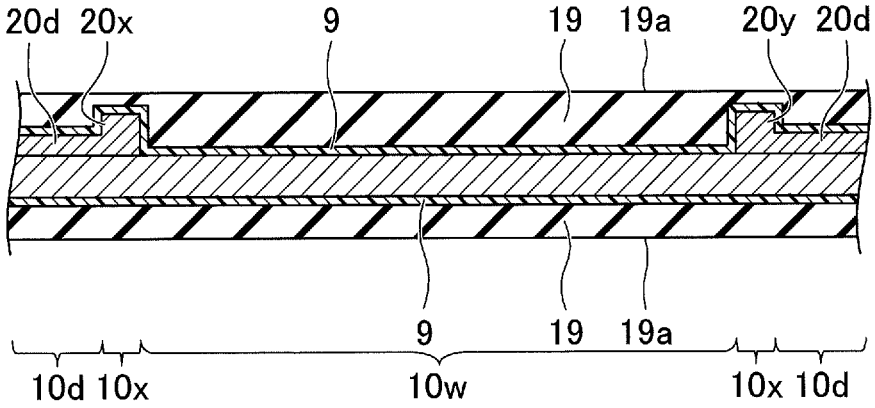

As illustrated in the cross-sectional view of FIG. 26C, the magnetic material 19 covering the insulating layers 9 on the front and back surfaces of the structure illustrated in FIG. 26B is formed similarly to the first embodiment illustrated in FIG. 4B and FIG. 5A. The magnetic material 19 contains a magnetic powder and an insulating resin similarly to the first embodiment.

Figure 27A:
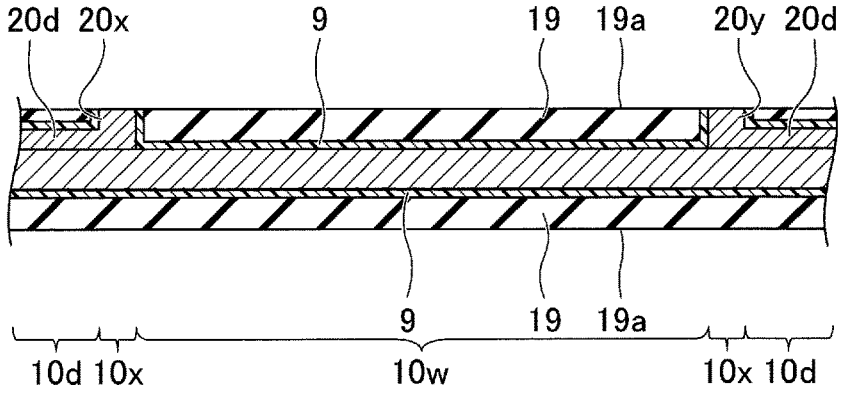
FIGS. 27A through 27C are cross-sectional views of the inductor of the second embodiment during the manufacturing stage.

As illustrated in the cross-sectional view of FIG. 27A, brush polishing or abrasive blasting is performed to polish the surface 19$a$ of the magnetic material 19 similarly to the first embodiment illustrated in FIG. 5B and FIG. 13, thereby removing the insulating layer 9 and the magnetic material 19 from the top of the third terminals 20$x$ and the fourth terminals 20$y$. With this arrangement, portions (i.e., the upper faces) of the third terminals 20$x$ and the fourth terminals 20$y$ are exposed at the surface 19$a$ of the magnetic material 19.

In the present embodiment, the metal plate is etched to a depth halfway through the thickness thereof to form the third terminals 20$x$ and the fourth terminals 20$y$ as illustrated in FIG. 22A. As a result, the third terminals 20$x$ and the fourth terminals 20$y$ are elevated from the frame member 20$d$, which makes it easier to expose the third terminals 20$x$ and the fourth terminals 20$y$ from the surface 19$a$ of the magnetic material 19.

Figure 27B:
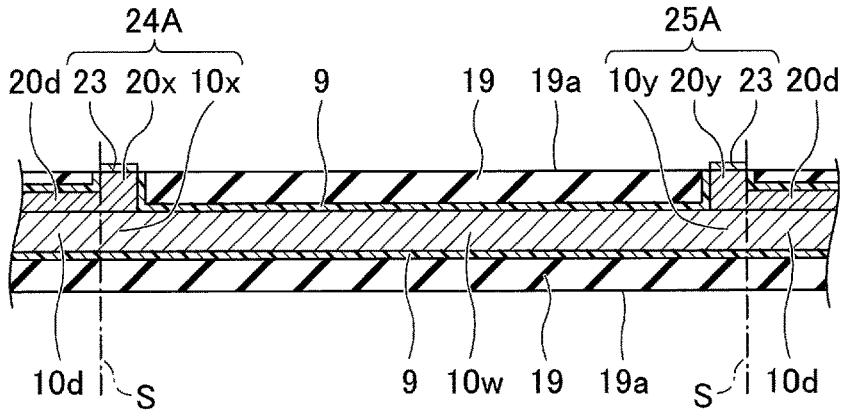

As illustrated in FIG. 27B, a nickel layer and a tin layer are formed in this order as the metal plating layer 23 by electrolytic plating on the upper faces of the third terminals 20$x$ and the fourth terminals 20$y$, similarly to the first embodiment illustrated in FIG. 6A through FIG. 7A. As a result, a first electrode 24A comprised of the first terminal 10$x$, the third terminal 20$x$, and the metal plating layer 23 is formed, and a second electrode 25A comprised of the second terminal 10$y$, the fourth terminal 20$y$, and the metal plating layer 23 is formed.

The metal plating layer 23 is not limited to a particular thickness. The nickel layer may have a thickness of approximately 2 micrometers, and the tin layer may have a thickness of approximately 5 micrometers, for example.

The metal plating layer 23 not only serves as an oxidation resistant layer for the third terminals 20$x$ and the fourth terminals 20$y$, but also serves to improve the solder wettability of the electrodes 24A and 25A. The metal plating layer 23 having such functions may alternatively be a multilayer film comprised of a nickel layer and a gold layer laminated in this order, or a multilayer film comprised of a silver layer and a tin layer laminated in this order.

Figure 27C:
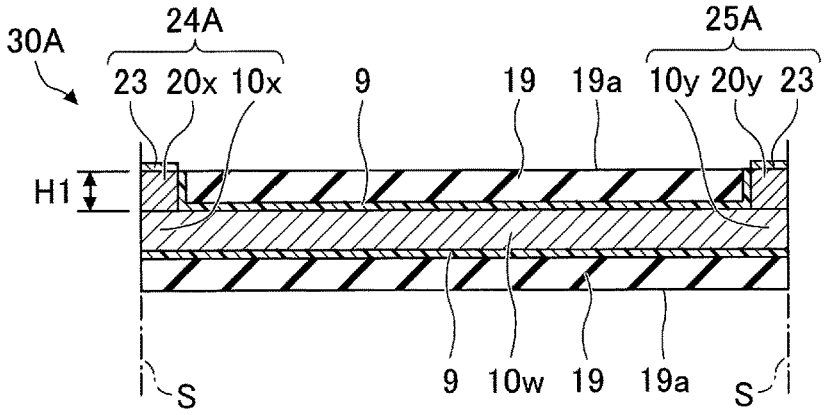

The structure illustrated in FIG. 27B is then cut along the cut lines S, resulting in the basic structure of the inductor 30A of the present embodiment being completed in final form as illustrated in the cross-sectional view of FIG. 27C. Similarly to FIG. 14 and FIG. 16, the inductor 30A is a square shape (or rectangular shape) with the length of a side being approximately 2.5 mm in the plan view. A side face of the first electrode 24A is exposed at one of the opposite side faces of the inductor 30A, and a side face of the second electrode 25A is exposed at the other one of the opposite side faces.

The inductor 30A has the following advantages in addition to the advantages of the inductor 30. With respect to the inductor 30, the vertical rise (excluding the metal plating layer 23) of the first electrodes 24 and the second electrodes 25 from the conductors 1$w$ is approximately half the thickness of the metal plate 1 (e.g., 0.1 mm). In the case of the inductor 30A, on the other hand, the vertical rise H1 (excluding the metal plating layer 23) of the first electrodes 24A and the second electrodes 25A from the conductors 10*w* is equal to the thickness of the metal plate 20 (e.g., 0.2 mm).

In this manner, the electrodes of the inductor 30A have a greater vertical rise than the electrodes of the inductor 30, so that the magnetic material 19 disposed on the conductors 10*w* is made correspondingly thicker. The inductance of the inductor 30A is thus made greater than the inductance of the inductor 30. As the vertical rise of the electrodes increases by 0.1 mm, for example, the inductance increases by 20%.

It may be noted that the structure and size of the conductors 10*w* do not have to be changed from those of the conductors 1*w*, so that there is only a slight increase in the DC resistance caused by an increase in the vertical rise of the electrodes.

Moreover, the adjustment of the vertical rise of the electrodes with respect to the inductor 30A allows the thickness of the magnetic material 19 disposed over the conductors 10*w* and the thickness of the magnetic material 19 disposed under the conductors 10*w* to be made evenly thicker. This serves to increase the inductance. This arrangement also allows the inductance of the inductor 30A to be readily adjusted. Further, the provision of the magnetic material 19 evenly over and under the conductors 10*w* serves to prevent the warpage of the inductor 30A.

[First Variation of Second Embodiment]

A first variation of the second embodiment is directed to an example in which the height of the first and second terminals is higher than that of the second embodiment. In connection with the first variation of the second embodiment, a description of the same or similar constituent elements as those of the previously provided descriptions may be omitted as appropriate.

The structure illustrated in FIG. 11 is made similarly to the first embodiment. The structure illustrated in FIG. 24 is made similarly to the second embodiment. As illustrated in the cross-sectional view of FIG. 28A, the structure illustrated in FIG. 24 is stacked on, and bonded to, the structure illustrated in FIG. 11. Bonding is made by using diffusion bonding, solder bonding, etc.

Each of the first terminal 1*x* and the second terminal 1*y* is an example of a first protuberance that is continuous and seamless with the conductor 1*w*. Each of the third terminal 20*x* and the fourth terminal 20*y* is an example of a second protuberance that is conductive and bonded on the first protuberance. Being continuous and seamless means that an object of interest is made by patterning a metal material by use of wet-etching, stamping, laser processing, or the like and that is not made by joining two or more conductors.

Figure 28A:
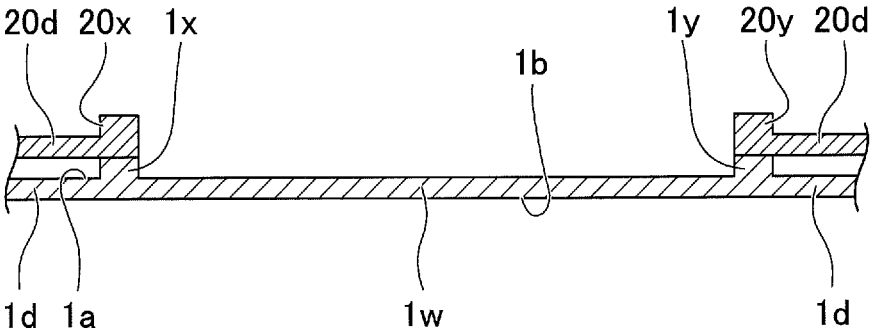
FIGS. 28A and 28B are cross-sectional views of an inductor according to a first variation of the second embodiment during the manufacturing stage.
Figure 28B:
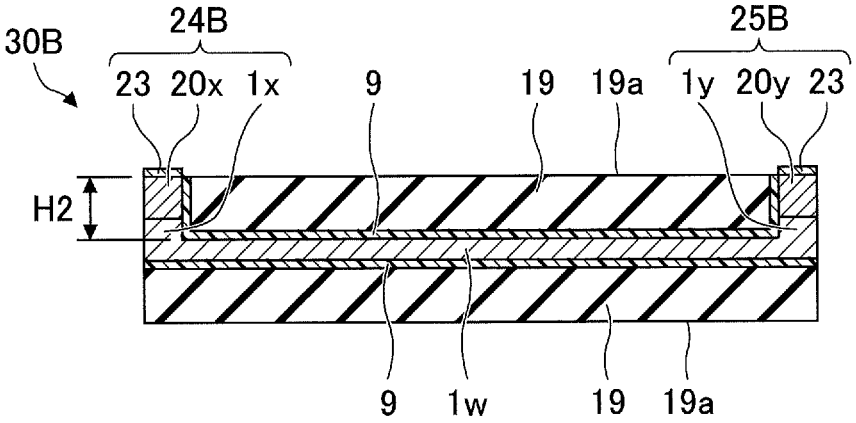

Process steps similar to those described by referring to the second embodiment illustrated in FIG. 26B through FIG. 27C are performed to complete the basic structure of the inductor 30B in final form as illustrated in the cross-sectional view of FIG. 28B. A first electrode 24B comprised of the first terminal 1*x*, the third terminal 20*x*, and the metal plating layer 23 is formed, and a second electrode 25B comprised of the second terminal 1*y*, the fourth terminal 20*y*, and the metal plating layer 23 is formed.

Similarly to FIG. 14 and FIG. 16, the inductor 30B is a square shape (or rectangular shape) with the length of a side being approximately 2.5 mm in the plan view. A side face of the first electrode 24B is exposed at one of the opposite side faces of the inductor 30B, and a side face of the second electrode 25B is exposed at the other one of the opposite side faces.

The inductor 30B has the following advantages in addition to the advantages of the inductor 30A. In the case of the inductor 30A (see FIG. 27C), the vertical rise H1 (excluding the metal plating layer 23) of the first electrodes 24A and the second electrodes 25A from the conductors 10*w* is approximately equal to the thickness of the metal plate 20 (e.g., 0.2 mm). In the case of the inductor 30B, on the other hand, the vertical rise H2 (excluding the metal plating layer 23) of the first electrodes 24B and the second electrodes 25B from the conductors 1*w* is equal to about half the thickness of the metal plate 1 plus the thickness of the metal plate 20 (e.g., H2 is approximately 0.3 mm).

In this manner, the electrodes of the inductor 30B have a greater vertical rise than the electrodes of the inductor 30A, so that the magnetic material 19 disposed on the conductors 1*w* is made correspondingly thicker. The inductance of the inductor 30B is thus made greater than the inductance of the inductor 30A.

[Second Variation of Second Embodiment]

A second variation of the second embodiment is directed to an example in which the first and second electrodes have a protuberance projecting from the surface of the magnetic material. In connection with the second variation of the second embodiment, a description of the same or similar constituent elements as those of the previously provided descriptions may be omitted as appropriate.

The structure illustrated in FIG. 26B is made similarly to the second embodiment. In so doing, the thickness of the metal plate 20 may be made thicker than in the second embodiment. With this arrangement, the third terminals 20*x* and the fourth terminals 20*y* have an increased vertical rise from the surface of the conductors 10*w*.

Figure 29A:
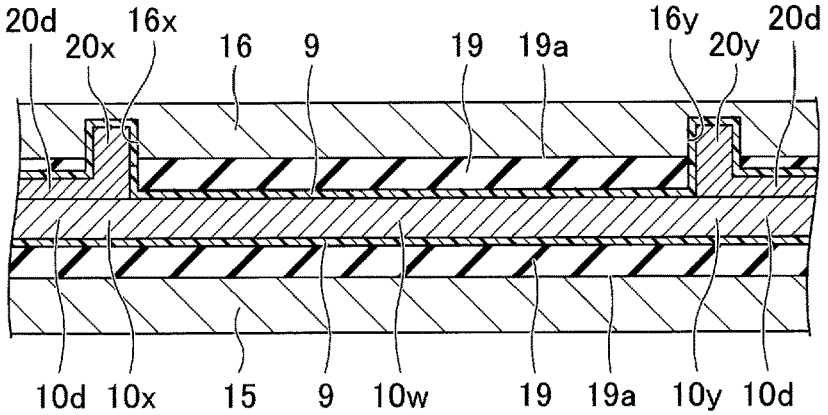
FIGS. 29A through 29C are cross-sectional views of an inductor according to a second variation of the second embodiment during the manufacturing stage.

As illustrated in the cross-sectional view of FIG. 29A, the structure illustrated in FIG. 26B is disposed between the lower mold 15 and the upper mold 16 of a hot press machine. Similarly to the first embodiment illustrated in FIG. 4B, the magnetic material 19 is formed on the upper side and lower side of the structure illustrated in FIG. 26B. This structure is then taken out of the space between the lower mold 15 and the upper mold 16.

In this variation, the upper mold 16 has recesses 16*x* and 16*y* into which the tips of the third terminals 20*x* and the fourth terminals 20*y* are inserted, respectively. The structure taken out of the space between the lower mold 15 and the upper mold 16 thus has the tips of the third terminals 20*x* and the fourth terminals 20*y* protruding from the surface 19*a* of the magnetic material 19. In this state, the tip portions of the third terminals 20*x* and the fourth terminals 20*y* protruding from the surface 19*a* of the magnetic material 19 are still covered with the insulating layer 9.

Figure 29B:
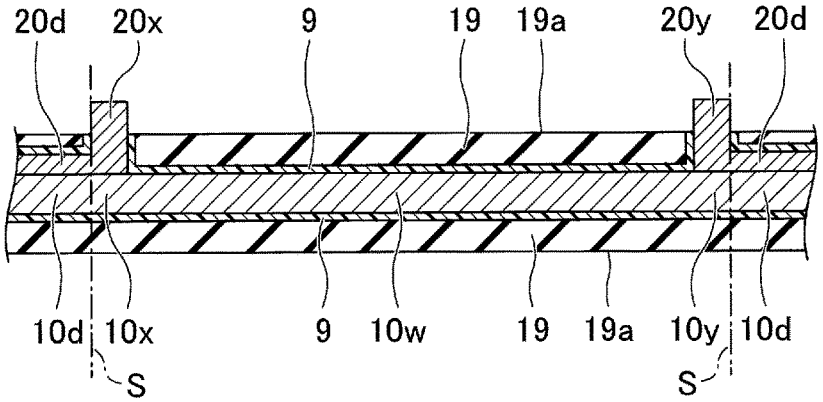

As illustrated in the cross-sectional view of FIG. 29B, brush polishing or abrasive blasting is performed to polish and remove the insulating layer 9 covering the tips of the third terminals 20*x* and the fourth terminals 20*y* protruding from the surface 19*a* of the magnetic material 19. With this arrangement, the tip portions of the third terminals 20*x* and the fourth terminals 20*y* protruding from the surface 19*a* of the magnetic material 19 are exposed without the insulating layer 9.

Figure 29C:
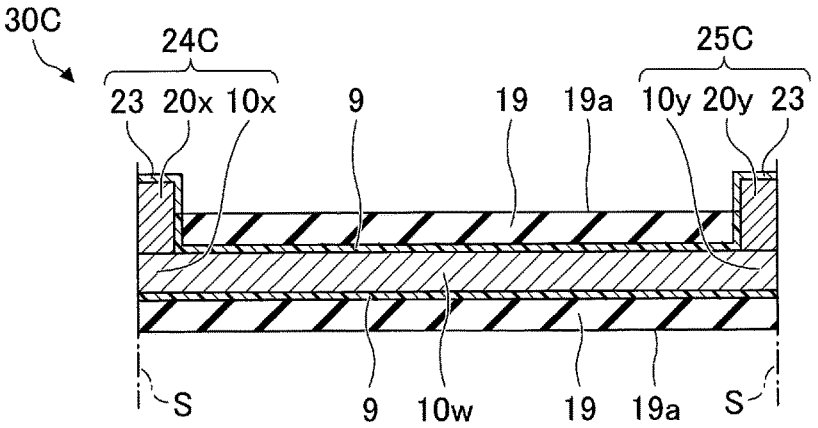

The metal plating layer 23 is then formed on the surfaces (i.e., the top face and side faces) of the portions of the third terminals 20*x* and the fourth terminals 20*y* protruding from the surface 19*a* of the magnetic material 19, similarly to the first embodiment illustrated in FIG. 6A through FIG. 7A. Subsequently, an individual piece is cut out. With this arrangement, the basic structure of the inductor 30C according to the second variation is completed in final form as illustrated in the cross-sectional view of FIG. 29C. A first electrode 24C comprised of the first terminal 10*x*, the third terminal 20*x*, and the metal plating layer 23 is formed, and a second electrode 25C comprised of the second terminal 10*y*, the fourth terminal 20*y*, and the metal plating layer 23 is formed.

Similarly to FIG. 14 and FIG. 16, the inductor 30C is a square shape (or rectangular shape) with the length of a side being approximately 2.5 mm in the plan view. A side face of the first electrode 24C is exposed at one of the opposite side faces of the inductor 30C, and a side face of the second electrode 25C is exposed at the other one of the opposite side faces. Further, the metal plating layer 23 of the first electrode 24C and the metal plating layer 23 of the second electrode 25C are exposed to the outside of the inductor 30C. The metal plating layer 23 is formed on the upper faces and side faces of the portions of the third terminals 20*x* and the fourth terminals 20*y* exposed from the magnetic material 19, except for the faces exposed at the side faces of the inductor 30C.

Figure 30:
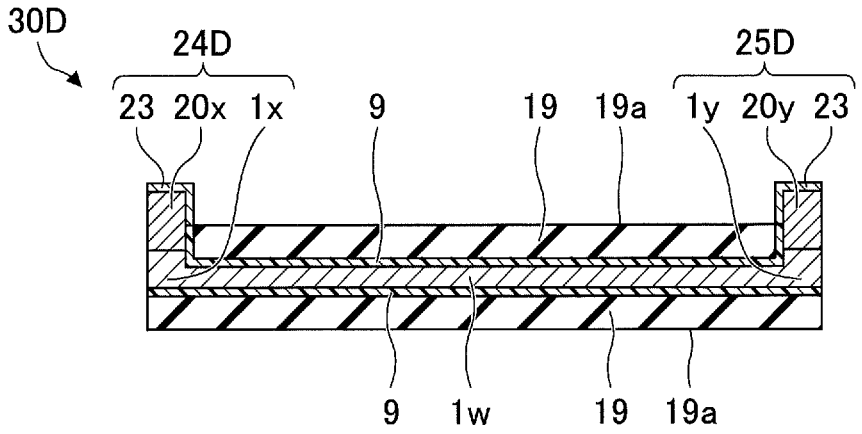
FIG. 30 is a cross-sectional view of the inductor according to the second variation of the second embodiment.

It may be noted that the structure illustrated in FIG. 28A may be used in place of the structure illustrated in FIG. 26B in the above-noted process steps so as to form an inductor 30D illustrated in FIG. 30. A first electrode 24D comprised of the first terminal 1*x*, the third terminal 20*x*, and the metal plating layer 23 is formed, and a second electrode 25D comprised of the second terminal 1*y*, the fourth terminal 20*y*, and the metal plating layer 23 is formed.

Similarly to FIG. 14 and FIG. 16, the inductor 30D is a square shape (or rectangular shape) with the length of a side being approximately 2.5 mm in the plan view. A side face of the first electrode 24D is exposed at one of the opposite side faces of the inductor 30D, and a side face of the second electrode 25D is exposed at the other one of the opposite side faces. Further, the metal plating layer 23 of the first electrode 24D and the metal plating layer 23 of the second electrode 25D are exposed to the outside of the inductor 30D. The metal plating layer 23 is formed on the upper faces and side faces of the portions of the third terminals 20*x* and the fourth terminals 20*y* exposed from the magnetic material 19, except for the faces exposed at the side faces of the inductor 30D.

The electrodes of the inductor 30D have a greater vertical rise than the electrodes of the inductor 30C, so that the magnetic material 19 disposed on the conductors 10*w* is made correspondingly thicker. The inductance of the inductor 30D is thus made greater than the inductance of the inductor 30C.

As illustrated in FIG. 31, another component is joined to make the first and second electrodes protrude from the surface of the magnetic material.

Figure 31A:
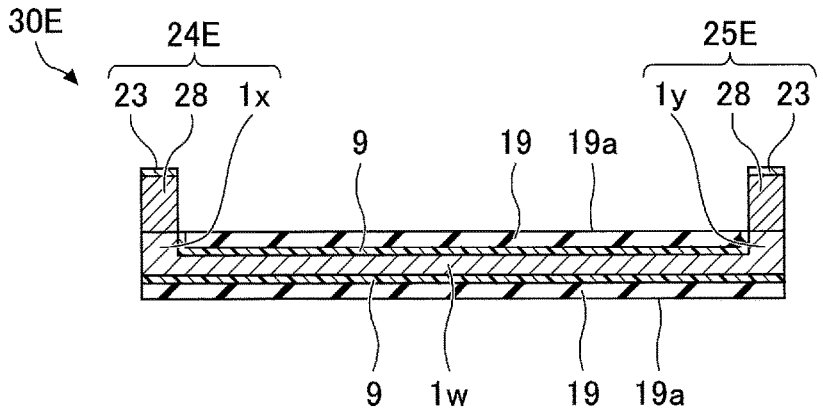
FIGS. 31A and 31B are drawings illustrating the inductor according to the second variation of the second embodiment.
Figure 31B:
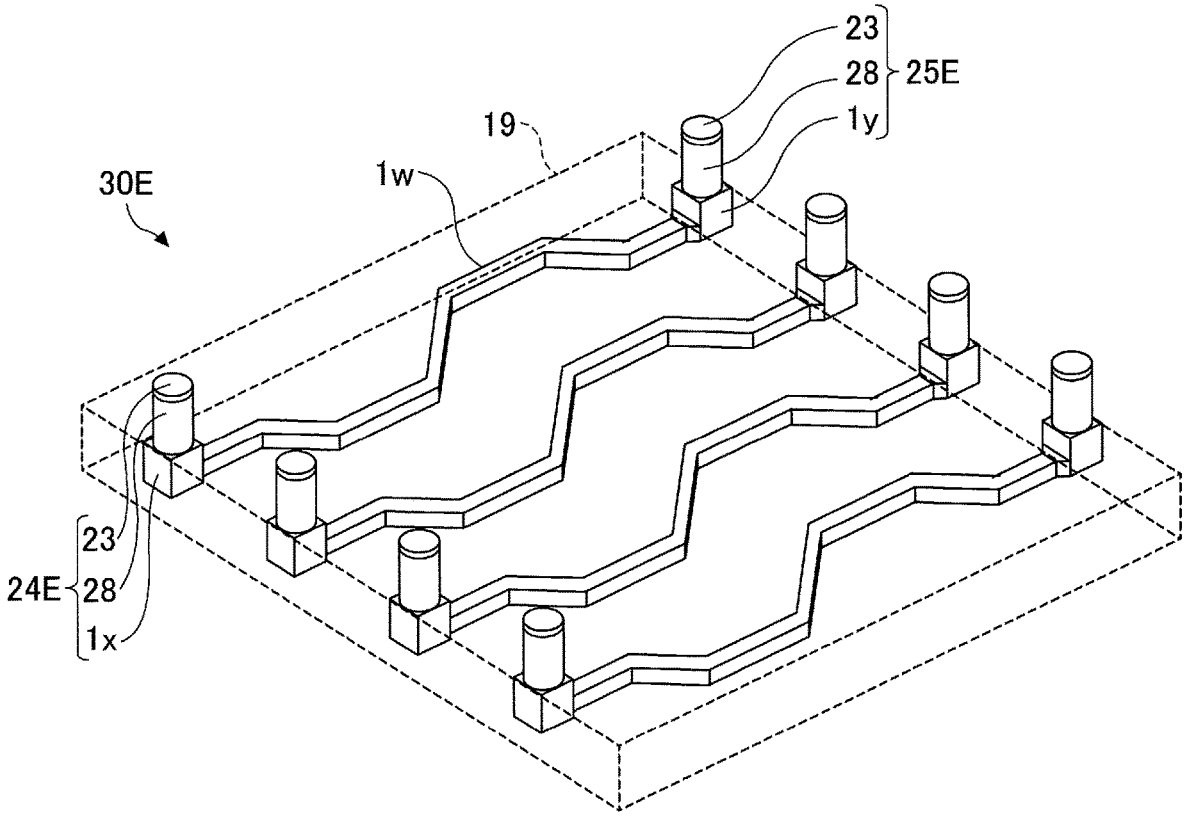

FIGS. 31A and 31B are drawings illustrating the inductor according to the second variation of the second embodiment. FIG. 31A is a cross-sectional view showing the first cross-section, and FIG. 31B is an axonometric view.

The inductor 30E illustrated in FIG. 31 is configured such that metal posts 28 are joined to the top of the first terminals 1*x* and the top of the second terminals 1*y* that are protruding from the conductors 1*w* of the structure illustrated in FIG. 11, for example, followed by forming the metal plating layer 23 at the end faces of the metal posts 28. The metal posts 28 are height adding conductive portions that increase the height of the protrusions from the surface of the conductors 1*w*. The metal posts 28 may be made of copper or a copper alloy, for example. The metal posts 28 may be joined to the first and second terminals 1*x* and 1*y* by diffusion bonding, solder bonding, etc. A conductive paste (e.g., silver paste) may be used in place of solder. The metal posts 28 may be a circular column, or may alternatively be a prismatic column.

The height of the metal posts 28 may be set to any desired value according to need.

The metal posts 28 may alternatively be joined to the third terminals 20*x* and the fourth terminals 20*y* illustrated in FIG. 27C or FIG. 28B.

With respect to the inductors 30C, 30D, and 30E, the first terminals and the second terminals are configured to protrude from the surface of the magnetic material. With such an arrangement, mounting the inductor 30C, 30D, or 30E on an interconnect substrate provides a space in which a semiconductor chip or a passive component may be disposed. Examples of a passive component include a resistor, a capacitor, and the like, for example.

Figure 32:
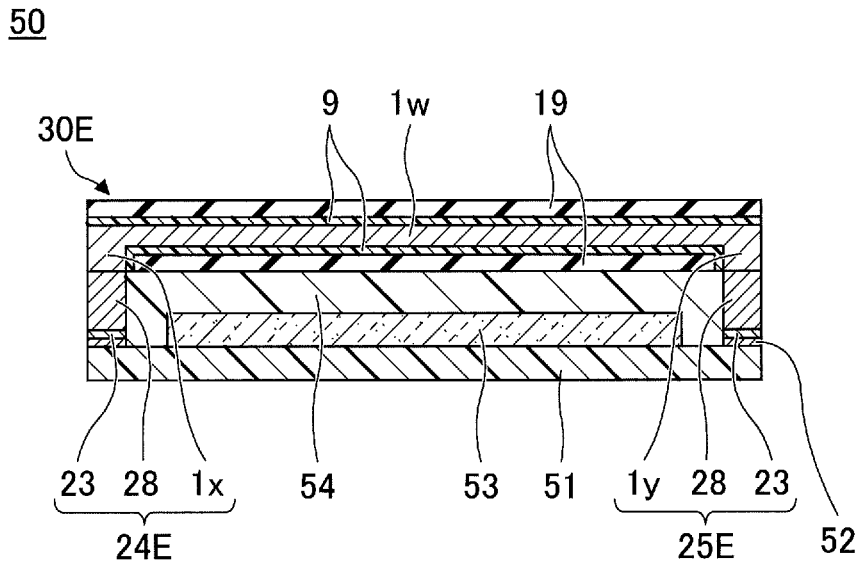
FIG. 32 is a cross-sectional view of an electronic device having the inductor of the second embodiment.

In the case of an electronic device 50 illustrated in FIG. 32, for example, the inductor 30E is mounted on a circuit substrate 51. The metal plating layer 23 of the first electrodes 24E and the second electrodes 25E of the inductor 30E is electrically coupled by solder or the like to electrode pads 52 disposed on the circuit substrate 51. A space formed over the circuit substrate 51 by mounting the inductor 30E on the circuit substrate accommodates a semiconductor chip 53, which is flip-chip mounted on the circuit substrate 51 and encapsulated in a mold resin 54. Instead of the semiconductor chip 53, or in addition to the semiconductor chip 53, one or more passive components such as capacitors or the like may be disposed in the space formed over the circuit substrate 51.

In this manner, a space formed by mounting on an interconnection substrate an inductance having the first and second electrodes protruding from the surface of a magnetic material may accommodate a semiconductor chip, passive components, and the like, thereby allowing the area of the interconnection substrate to be reduced. Further, the long extension of the first and second electrodes enables efficient heat radiation of heat generated by the inductance through the first and second electrodes.

According to at least one embodiment, a thin inductor is provided.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

The disclosures herein include the subject-matter as set out in the following clauses:

1. A method of making an inductor, comprising:

forming a conductive line having a first electrode at one end thereof and a second electrode at another end thereof;

embedding the conductive line in a magnetic material containing a magnetic powder and an insulating resin; and exposing part of the first electrode and part of the second electrode from the magnetic material.

2. The method as recited in clause 1, wherein the step of forming a conductive line includes patterning a metal plate to produce the conductive line.

3. The method as recited in clause 2, wherein the step of forming a conductive line includes thinning the metal plate, except for portions of the metal plate that correspond to the first electrode and the second electrode.

4. The method as recited in clause 1, further comprising joining a separate conductor to a top of the first electrode and a separate conductor to a top of the second electrode.

What is claimed is:

1. An inductor, comprising:

a magnetic material containing a magnetic powder and an insulating resin;

a conductive line embedded in the magnetic material;

a first electrode partially exposed from the magnetic material and connected to one end of the conductive line; and a second electrode partially exposed from the magnetic material and connected to another end of the conductive line, wherein each of the first electrode and the second electrode has a conductive protuberance projecting from a surface of the conductive line, and wherein the protuberance is continuous and seamless with the conductive line.

2. The inductor as claimed in claim 1, further comprising an insulating layer covering the conductive line as a coating.

3. The inductor as claimed in claim 1, wherein the conductive line extends in a meandering manner in a plan view.

4. The inductor as claimed in claim 1, wherein the conductive line extends straight in a plan view.

5. The inductor as claimed in claim 1, comprising a plurality of said conductive lines embedded in the magnetic material, the conductive lines extending side by side.

6. The inductor as claimed in claim 1, wherein the conductive line is a metal strip.

7. The inductor as claimed in claim 1, wherein the protuberance includes a first protuberance and a second protuberance, the first protuberance being continuous and seamless with the conductive line, and the second protuberance being joined to a top of the first protuberance.

8. The inductor as claimed in claim 1, wherein the protuberance is exposed, or projects, from a surface of the magnetic material.

9. The inductor as claimed in claim 1, further comprising a height adding conductive member that is joined to a top of the protuberance and that increases a height from the surface of the conductive line.

10. The inductor as claimed in claim 1, wherein the magnetic material has a cuboid shape with a first side face, a second side face opposite the first side face, and a lower face situated between the first side face and the second side face, wherein a side face and a lower face of the first electrode are exposed at the first side face and the lower face of the magnetic material, respectively, and a side face and a lower face of the second electrode are exposed at the second side face and the lower face of the magnetic material, respectively.

11. The inductor as claimed in claim 1, wherein the magnetic material has a cuboid shape with a first side face and a second side face opposite the first side face, wherein a side face of the first electrode is flush with the first side face of the magnetic material, and a side face of the second electrode is flush with the second side face of the magnetic material.

12. An inductor, comprising:

a magnetic material containing a magnetic powder and an insulating resin;

a conductive line embedded in the magnetic material;

a first electrode partially exposed from the magnetic material and connected to one end of the conductive line; and a second electrode partially exposed from the magnetic material and connected to another end of the conductive line, wherein each of the first electrode and the second electrode has a conductive protuberance projecting from a surface of the conductive line, and wherein the conductive line has a flat surface extending along a longitudinal extension thereof, and the protuberance is a separate conductor joined to the flat surface of the conductive line.

13. The inductor as claimed in claim 12, further comprising an insulating layer covering the conductive line as a coating.

14. The inductor as claimed in claim 12, wherein the conductive line extends in a meandering manner in a plan view.

15. The inductor as claimed in claim 12, wherein the conductive line extends straight in a plan view.

16. The inductor as claimed in claim 12, comprising a plurality of said conductive lines embedded in the magnetic material, the conductive lines extending side by side.

17. The inductor as claimed in claim 12, wherein the conductive line is a metal strip.

18. The inductor as claimed in claim 12, wherein the protuberance is exposed, or projects, from a surface of the magnetic material.

19. The inductor as claimed in claim 12, further comprising a height adding conductive member that is joined to a top of the protuberance and that increases a height from the surface of the conductive line.

20. The inductor as claimed in claim 12, wherein the magnetic material has a cuboid shape with a first side face, a second side face opposite the first side face, and a lower face situated between the first side face and the second side face, wherein a side face and a lower face of the first electrode are exposed at the first side face and the lower face of the magnetic material, respectively, and a side face and a lower face of the second electrode are exposed at the second side face and the lower face of the magnetic material, respectively.

21. The inductor as claimed in claim 12, wherein the magnetic material has a cuboid shape with a first side face and a second side face opposite the first side face, wherein a side face of the first electrode is flush with the first side face of the magnetic material, and a side face of the second electrode is flush with the second side face of the magnetic material.

* * * * *